US007331497B2

(12) United States Patent
Cooper et al.

(10) Patent No.: US 7,331,497 B2
(45) Date of Patent: Feb. 19, 2008

(54) TOOL FOR DISPENSING PLASTIC FASTENERS

(75) Inventors: William J. Cooper, Woonsocket, RI (US); Jeffrey A. Raymond, Leominster, MA (US)

(73) Assignee: Avery Dennison Corporation, Pasadena, CA (US)

( * ) Notice: Subject to any disclaimer, the term of this patent is extended or adjusted under 35 U.S.C. 154(b) by 698 days.

(21) Appl. No.: 10/306,900

(22) Filed: Nov. 27, 2002

(65) Prior Publication Data

US 2003/0218043 A1 Nov. 27, 2003

Related U.S. Application Data

(60) Provisional application No. 60/334,026, filed on Nov. 27, 2001.

(51) Int. Cl.
*B65C 5/06* (2006.01)

(52) U.S. Cl. ..... 227/67; 227/71

(58) Field of Classification Search ..... 227/67, 227/71; 29/432; 221/197
See application file for complete search history.

(56) References Cited

U.S. PATENT DOCUMENTS 3,650,452 A * 3/1972 Finke ..... 227/67
3,759,435 A * 9/1973 Bone ..... 227/67
3,880,339 A 4/1975 Bone
3,901,428 A * 8/1975 Grass ..... 227/67
4,416,407 A * 11/1983 Bone ..... 227/67
4,683,635 A * 8/1987 Duchin ..... 29/432
5,033,664 A * 7/1991 Bone et al. ..... 227/67
5,472,130 A 12/1995 Beringhause et al.
5,501,002 A 3/1996 Fukami
5,683,025 A * 11/1997 Grendol ..... 227/67
5,772,073 A * 6/1998 Deschenes ..... 221/197
5,826,775 A * 10/1998 Mooney et al. ..... 227/67
5,950,901 A 9/1999 Kubota
6,267,285 B1 7/2001 Raymond et al.
6,655,571 B2 * 12/2003 Ueno ..... 227/67

OTHER PUBLICATIONS

International Search Report for PCT Application No. PCT/US02/37992, (the corresponding PCT application to the present application), mailed Dec. 9, 2003.

* cited by examiner

*Primary Examiner*—Scott A. Smith
(74) *Attorney, Agent, or Firm*—Kriegsman & Kriegsman

(57) ABSTRACT

A tool for dispensing fasteners from a fastener clip having a runner bar comprises a housing shaped to include a handle portion, a barrel portion and a guide channel for receiving the used portion of the runner bar. A trigger assembly is pivotally mounted in the handle portion. The tool also includes a needle slide slidably mounted in the barrel portion, a needle coupled to the needle slide, and a needle slide link coupling the needle slide to the trigger assembly. An ejector slide is slidably mounted within the needle slide and adapted to receive an ejector rod which is insertable back and forth through the hollow needle. The needle slide and the ejector slide are independently coupled to the trigger assembly. An anvil extends out in front of the barrel portion and is adapted to receive a removable brush, the needle being aligned to selectively project into the brush.

4 Claims, 25 Drawing Sheets

TOOL FOR DISPENSING PLASTIC FASTENERS

CROSS-REFERENCE TO RELATED APPLICATIONS

The present application claims the benefit under 35 U.S.C. § 119(e) of U.S. Provisional Patent Application Ser. No. 60/334,026, filed Nov. 27, 2001.

BACKGROUND OF THE INVENTION

The present invention relates generally to the fastening of objects using plastic fasteners and relates more particularly to a novel tool for dispensing plastic fasteners.

Certain articles of clothing, most notably men's dress shirts, are often packaged and sold in a folded condition so as to minimize any wrinkling of the article and so as to present the article in an otherwise flattering manner. Typically, the article is maintained in a folded condition by means of one or more straight metal pins, each of said straight metal pins typically comprising an elongated shaft terminating at one end in a sharp tip designed to penetrate the article and at the other end in a rounded head designed not to penetrate the article. Typically in use, the article is folded, and a plurality of pins are used to maintain the article in its folded condition by securing the article to itself at a plurality of different locations. Often, in the case of men's dress shirts, one or more of said pins are additionally used to secure the shirt to a piece of cardboard or to a similar backing material. The act of using straight metal pins to maintain an article of clothing in a folded condition is typically referred to in the art as "shirt-pining."

Although straight metal pins have achieved widespread use in maintaining articles of clothing in a folded condition, certain shortcomings are associated therewith. One such shortcoming is that no suitable tool exists for dispensing such pins into an article of clothing; consequently, the pins must be inserted manually. As can readily be appreciated, the repeated insertion of such pins into articles of clothing, over time, can become both physically and mentally taxing. Another shortcoming associated with the use of straight metal pins is that the pins, as noted above, have sharp ends, which can cause injury both to the person who must insert the pin into the article and to the person (i.e., consumer) who must remove the pin from the article. Moreover, once the pins are removed from the article, they must be disposed of properly to avoid injury to others. Still another shortcoming associated with the use of straight metal pins is that such pins, when inserted, may cause damage to the article, either by snagging and tearing the article or by creating a conspicuous insertion hole in the article. Still yet another shortcoming associated with the use of straight metal pins is that such pins, once inserted into an article of clothing, can be difficult to access and manipulate in such a way as to enable their removal.

Plastic fasteners of the type comprising an elongated flexible filament having a first enlargement at one end thereof and a second enlargement at the opposite end thereof are well-known and have been widely used in the attachment of merchandise tags to articles of commerce, in the coupling or re-coupling of buttons to garments, in the binding of a shoe upper during the process of shoe-lasting, and in various packing applications. In one common type of plastic fastener (see, for example, FIG. 1 of U.S. Pat. No. 5,321,872, which patent is incorporated herein by reference), the first enlargement has the shape of a first transverse bar and the second enlargement has the shape of a paddle or the shape of a second transverse bar, the first transverse bar and the paddle (or second transverse bar) extending in planes parallel to one another. In another common type of plastic fastener (see, for example, U.S. Pat. No. 3,494,004, which patent is incorporated by reference), the first enlargement has the shape of a transverse bar and the second enlargement has the shape of a knob or pin head. In still another common type of plastic fastener (see, for example, U.S. Pat. No. 4,240,183, which patent is incorporated herein by reference), the first enlargement has the shape of a transverse bar or the shape of a plug and the second enlargement has the shape of a socket, said socket being adapted to receive said transverse bar or said plug.

Plastic fasteners of the various types described above are typically molded as parts of a unitary fastener clip. A first example of such a fastener clip is disclosed in U.S. Pat. No. 3,733,657, which patent is incorporated herein by reference. The clip of the aforementioned '657 patent includes a plurality of fasteners, each of said fasteners comprising a flexible filament having a first transverse bar (or "cross-bar") at one end thereof and a paddle or second transverse bar (or "cross-bar") at the opposite end thereof, the transverse bar and the paddle (or second transverse bar) of each fastener extending in planes parallel to one another. The fasteners are arranged relative to one another so that respective transverse bars are spaced apart and oriented side-by-side and parallel to one another and so that the respective paddles (or second transverse bars) are spaced apart and oriented side-by-side and parallel to one another. The clip of foregoing '657 patent also includes a runner bar, said runner bar extending perpendicularly relative to the respective transverse bars and being connected to each of the transverse bars by a severable connector. The clip of said '657 patent further includes a severable member interconnecting each pair of adjacent paddles (or second transverse bars).

Several commercial embodiments of the aforementioned fastener clip have been sold by the present assignee, Avery Dennison Corporation, as DENNISON® SWIFTACH® fastener clips. DENNISON® SWIFTACH® fastener clips comprising fasteners of the type having a cross-bar at one end of a flexible filament and a paddle at the opposite end of the flexible filament are generally made of polypropylene or nylon and are typically used to attach merchandise tags and the like to articles of clothing. The filaments of such fasteners are typically at least about 12.5 mm in length. DENNISON® SWIFTACH® fastener clips comprising fasteners of the type having a first cross-bar at one end of a flexible filament and a second cross-bar at the opposite end of the flexible filament are made of nylon and are used to attach merchandise tags and the like to a wide variety of articles of commerce. In addition, such fasteners are used in shoe-lasting applications and in packaging applications, where the high tensile strength afforded by the use of nylon in the fastener is desirable. The filaments of such fasteners are typically at least about 6.35 mm in length.

A second type of fastener clip (or "fastener stock") is disclosed in U.S. Pat. No. 4,039,078, inventor Bone, issued Aug. 2, 1977, which patent is incorporated herein by reference. In said patent, the fastener stock comprises two undivided elongated and continuous plastic side members having a plurality of plastic cross links coupled to and between each of said side members, each of the links being preferably spaced equidistantly apart from each other. The fastener stock is designed to be separated or divided, e.g., by cutting, severing, rupturing or shearing the side members, to provide a plurality of fasteners, each of said fasteners preferably having a substantially H shape. A commercial embodiment of the fastener stock has been sold by the present assignee, Avery Dennison Corporation, as DENNISON® PLASTIC STAPLE™ fasteners.

U.S. Pat. No. 6,267,285, which is incorporated herein by reference, discloses a handheld tool for dispensing individual fasteners from the second type of fastener clip described above (e.g., a clip of the DENNISON® PLASTIC STAPLE™ fasteners). The tool of the aforementioned '285 patent is designed principally for use in shirt-pining applications and comprises a gun-shaped casing which includes a handle portion and a barrel portion, the barrel portion being provided with an opening. A needle carrier is slidably mounted in the barrel portion of the casing. A hollow, slotted needle is coupled to the needle carrier and is insertable back and forth between a retracted position and an extended position extending through the opening in the casing. An ejector rod carrier is slidably mounted in the barrel portion of the casing. An ejector rod is coupled to the ejector rod carrier and is insertable back and forth through the hollow, slotted needle. A linking member is coupled to the needle carrier and is selectively engageable with the ejector rod carrier for coupling and decoupling the needle carrier to and from the ejector rod carrier so that the needle carrier is caused to slide back and forth in the barrel portion only during a portion of the movement of the ejector rod carrier. A triggering mechanism comprises a trigger which is pivotally mounted in the casing and which extends partially through the handle portion thereof for manual actuation. The triggering mechanism further comprises a lever disposed within the casing. The lever is pivotally mounted at a first end on a first pin which is fixed to the trigger. The lever is pivotally mounted at a second end on a second pin which is fixed to the ejector rod carrier.

Although well-known in commerce, the tool of the aforementioned '285 patent suffers from a couple notable drawbacks.

As a first drawback, the tool is not adapted to dispense fasteners from the first type of fastener clip (i.e., a clip comprising plurality of fasteners which are attached to a common runner bar). Rather, the tool is limited to dispensing plastic fasteners from a fastener clip which does not include a common runner bar.

As a second drawback, the process of coupling and decoupling the needle carrier to and from the ejector rod carrier during the process of dispensing an individual fastener serves to roughen the trigger stroke of the tool.

As a third drawback, the process of coupling and decoupling the needle carrier to and from the ejector rod carrier during each trigger stroke is mechanically complex in nature, thereby rendering the tool more unreliable over time.

SUMMARY OF THE INVENTION

It is an object of the present invention to provide a new and improved tool for dispensing individual plastic fasteners from a fastener clip.

It is another object of the present invention to provide a new and improved tool for dispensing individual plastic fasteners from a fastener clip which includes a common runner bar.

It is yet another object of the present invention to provide a tool as described above which has a smooth trigger stroke.

It is yet still another object of the present invention to provide a tool as described above which is reliable.

It is yet a further object of the present invention to provide a tool as described above which has a limited number of parts, which is easy to use and which is inexpensive to manufacture.

Therefore, according to one aspect of the invention, a tool for dispensing plastic fasteners from a fastener clip is provided, each plastic fastener having a cross-bar, said tool comprising a housing comprising a handle portion and a barrel portion, a trigger assembly comprising a trigger which is pivotally mounted in said housing and which extends partially through the handle portion thereof for actuation, a needle assembly comprising a needle slide slidably mounted in the barrel portion of said housing, a hollow, slotted needle coupled to said needle slide, and a needle slide link coupling said needle slide to said trigger assembly, and an ejection mechanism coupled to said trigger assembly, said ejection mechanism comprising an ejector rod which is insertable back and forth through said hollow needle.

According to another aspect of the invention, a tool for dispensing plastic fasteners from a fastener clip is provided, each plastic fastener having a cross-bar coupled to a common runner bar through a stub, said tool comprising a housing comprising a handle portion and a barrel portion, said housing being shaped to define a runner bar guide channel, the runner bar guide channel being adapted to receive the common runner bar of said fastener clip, a trigger assembly comprising a trigger which is pivotally mounted in said housing and which extends partially through the handle portion thereof for actuation, a needle assembly slidably mounted in the barrel portion of said housing, said needle assembly comprising a hollow, slotted needle, and an ejection mechanism slidably mounted in the barrel portion of said housing, said ejection mechanism comprising an ejector rod which is insertable back and forth through said hollow needle.

According to another aspect of the invention, a tool for dispensing plastic fasteners from a fastener clip is provided, each plastic fastener having a cross-bar, said tool comprising a housing comprising a handle portion and a barrel portion, said barrel portion being provided with an opening, a trigger assembly comprising a trigger which is pivotally mounted in said housing and which extends partially through the handle portion thereof for actuation, a needle assembly slidably mounted in the barrel portion of said housing, said needle assembly comprising a hollow, slotted needle which is insertable back and forth through the opening in said housing, an ejection mechanism slidably mounted in the barrel portion of said housing, said ejection mechanism comprising an ejector rod which is insertable back and forth through said hollow needle, and an anvil assembly extending in front of the opening in said housing, said anvil assembly comprising, an anvil coupled to said housing, and a brush removably mounted onto said anvil.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
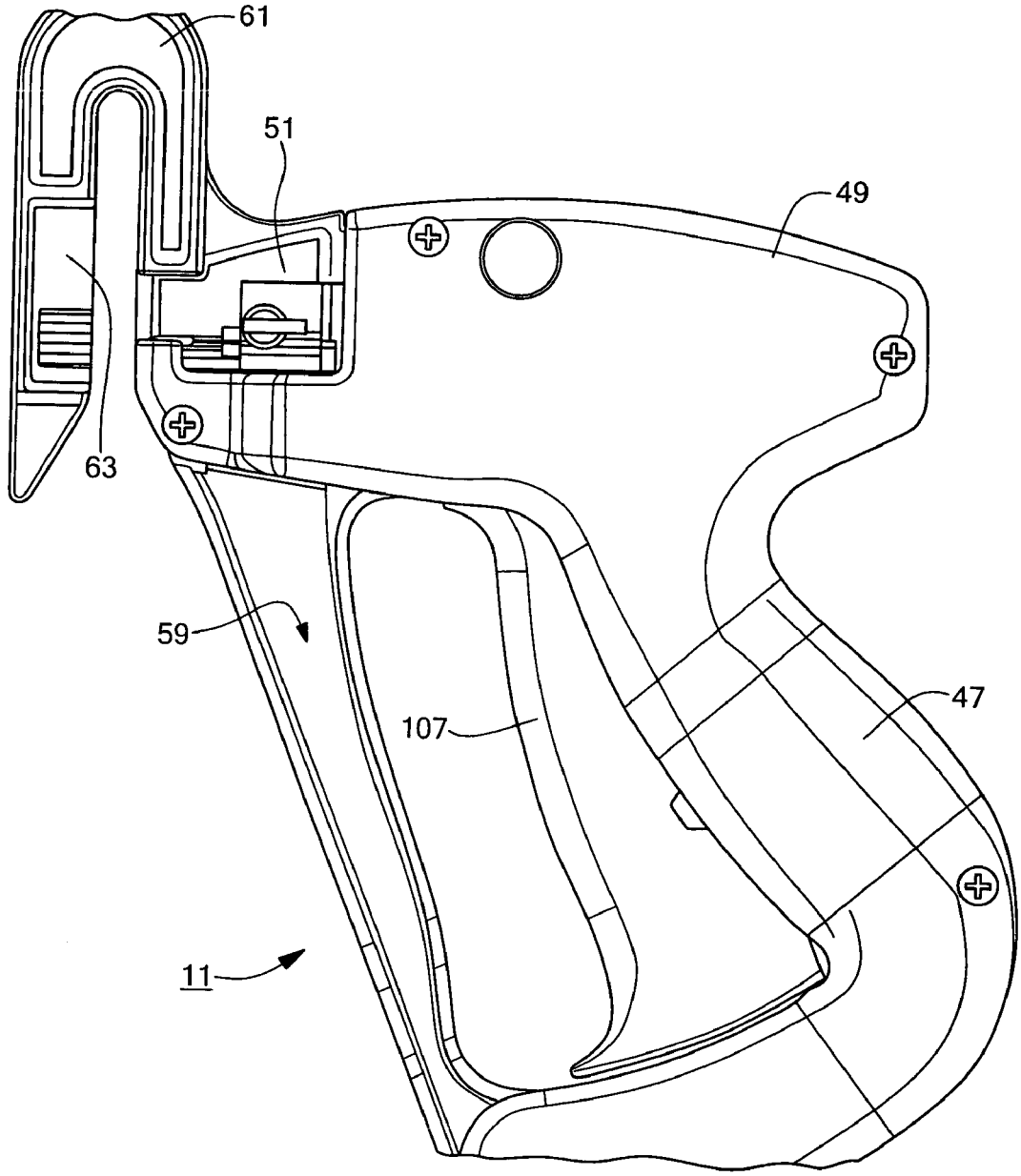
FIG. 1 is a fragmentary, left side view of a tool constructed according to the teachings of the present invention, the tool being well-suited for use in dispensing individual fasteners from a fastener clip.

Referring now to FIG. 1, there is shown a tool for dispensing individual plastic fasteners from a fastener clip, the tool being constructed according to the teachings of the present invention and identified generally by reference numeral 11. As will be described further in detail below, tool 11 is designed principally for use in shirt-pining applications (i.e., dispensing individual plastic fasteners through a shirt so as to retain the shirt in a folded condition).

Tool 11 is designed for use in dispensing individual plastic fasteners from a fastener clip of the type which includes a common runner bar. Referring now to FIGS. 7-10, there is shown one type of fastener clip 13 which can used in conjunction with tool 11. Fastener clip 13, which is a unitary structure preferably made by molding, comprises a plurality of individual fasteners 15, fasteners 15 being arranged in a parallel, side-by-side, spaced orientation.

Figure 11A:
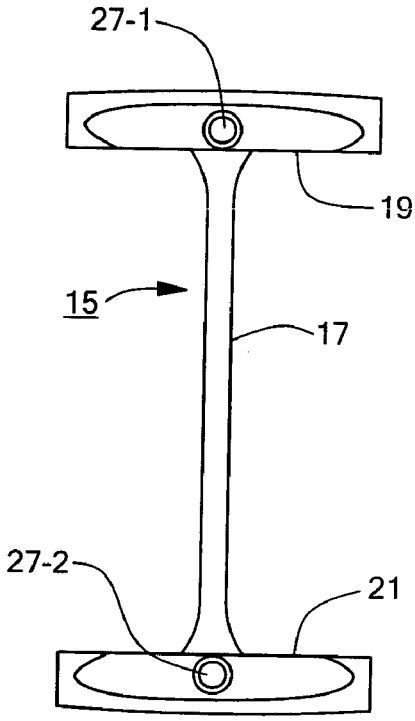
FIGS. 11(*a*) through 11(*c*) are enlarged front, top and left side views, respectively, of an individual fastener in the fastener clip shown in FIG. 7.
Figure 11B:
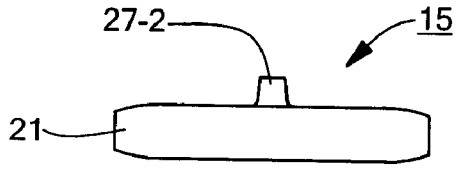
Figure 11C:
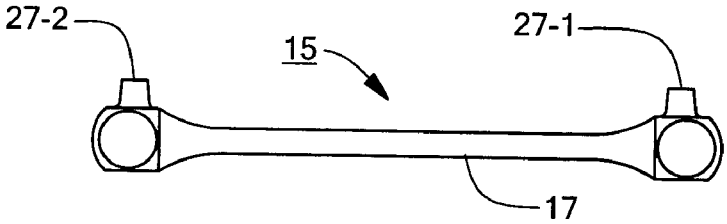

As seen most clearly in FIGS. 11(*a*) through 11(*c*), each fastener 15 includes a flexible filament 17, a first cross-bar 19 disposed at a first end of filament 17 and a second cross-bar 21 disposed at a second end of filament 17, cross-bars 19 and 21 being parallel to one another.

Figure 10:
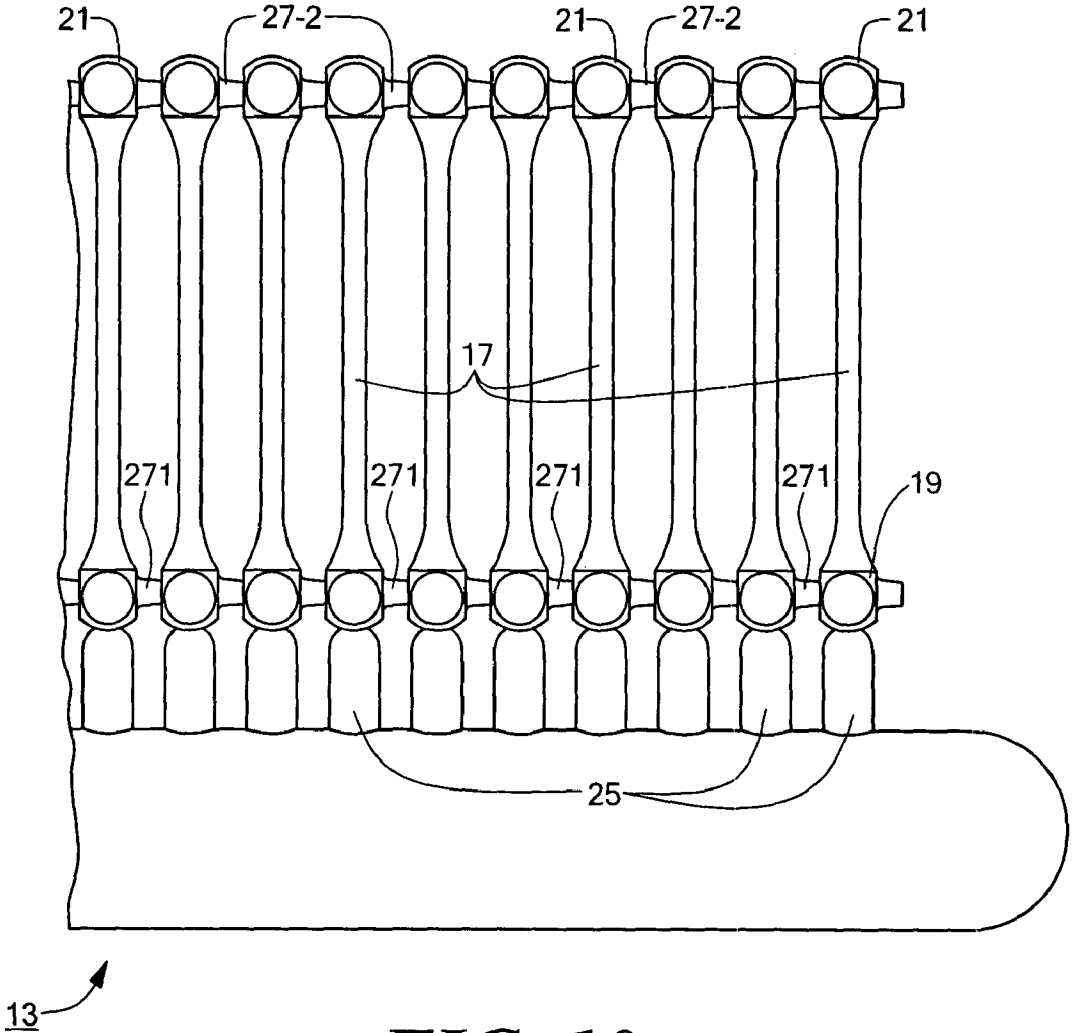
FIG. 10 is an enlarged, fragmentary, left side view of the fastener clip shown in FIG. 7.
Figure 8:
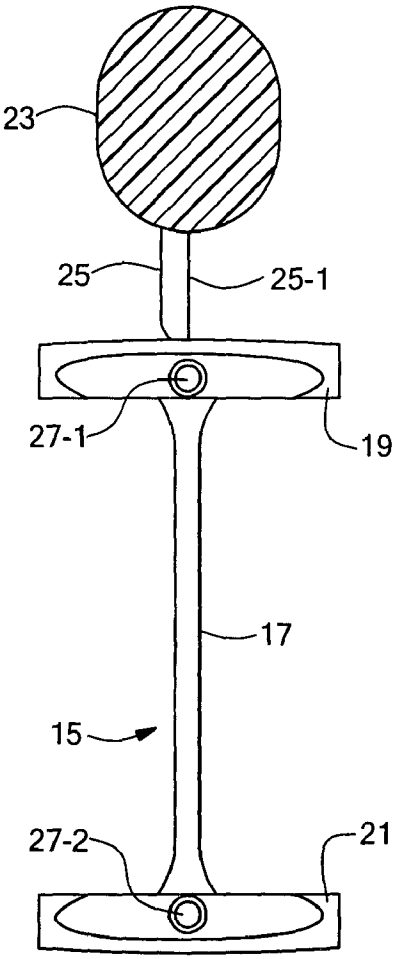
FIG. 8 is an enlarged, lateral section view of the fastener clip shown in FIG. 7, taken along lines 8-8.
Figure 9:
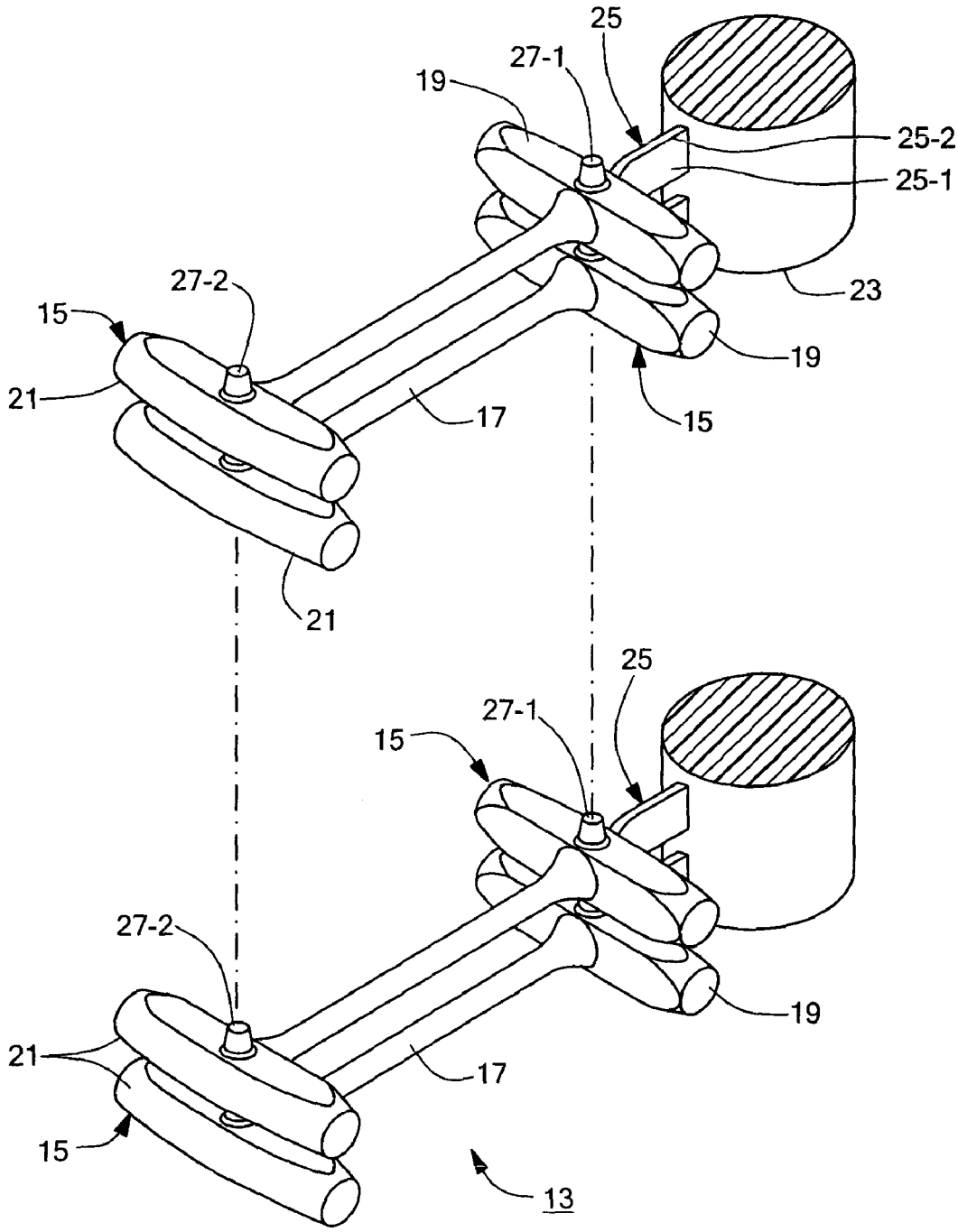
FIG. 9 is an enlarged, fragmentary, left rear top perspective view of the fastener slip shown in FIG. 7.

Each fastener 15 is coupled to a common runner bar 23 through a short off center stub 25, as seen most clearly in FIGS. 8-10. Stub 25 couples first cross-bar 19 to runner bar 23, stub 25 being aligned slightly off-center of the longitudinal axis of filament 17. Stub 25 has an inner surface 25-1 which is flat and which terminates at one end in a sharp edge 25-2. As will be described further in detail below, sharp edge 25-2 of each stub 25 is sized and shaped for engagement by a feed pawl in tool 11.

Successive fasteners 15 are coupled together by first and second severable connector posts 27-1 and 27-2. Specifically, connector posts 27-1 couple the mutually opposing sides of adjacent cross-bars 19 at their approximate midpoints and extend in a substantially perpendicular direction relative to the longitudinal axes of cross-bars 19. Similarly, connector posts 27-2 couple the mutually-opposing sides of adjacent cross-bars 21 at their approximate midpoints and extend in a substantially perpendicular direction relative to the longitudinal axes of cross-bars 21.

Fastener clip 13 is preferably made of a plastic such as nylon, polyethylene or polypropylene and is manufactured to include one hundred and twenty individual fasteners 15 with a pitch (i.e., distance between successive filaments 17) of approximately 0.032 inches.

Figure 7:
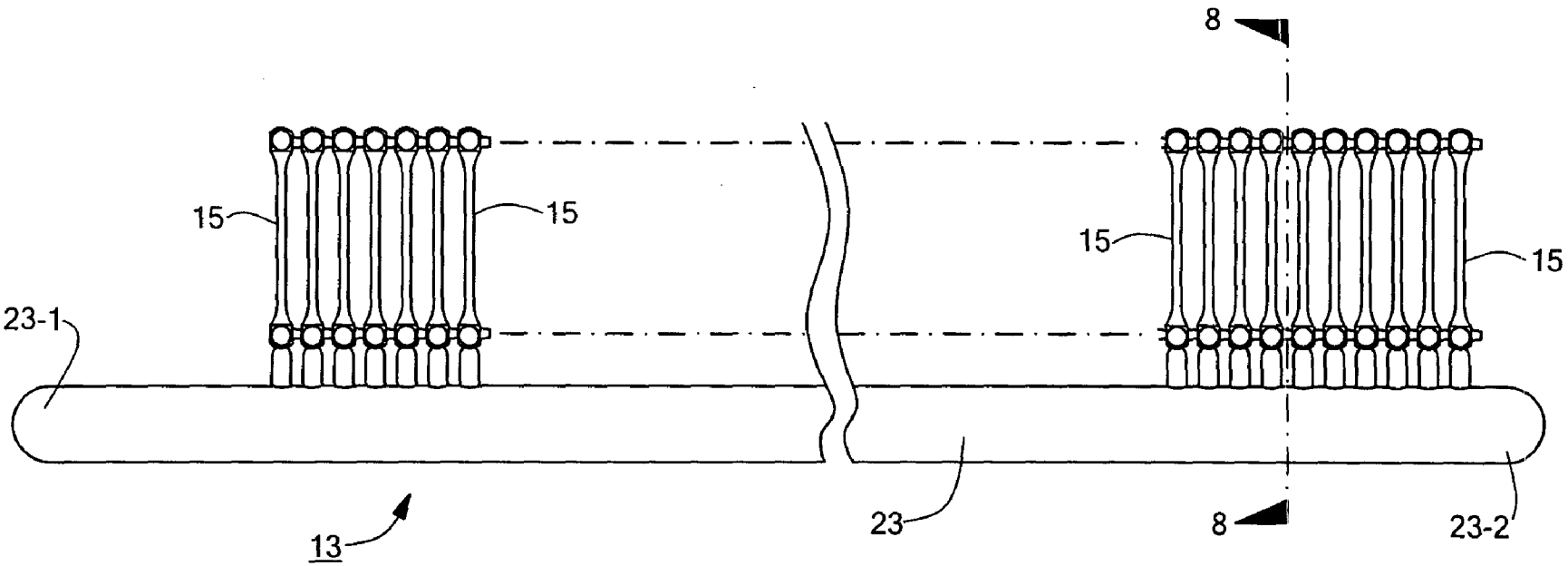
FIG. 7 is a left side view of a fastener clip constructed according to this invention, the fastener clip being well-suited for use in the tool shown in FIG. 1.

Runner bar 23 has a first end 23-1 and a second end 23-2, first end 23-1 serving as the end of runner bar 23 that is inserted into fastener dispensing tool 11. As can be seen in FIG. 7, first end 23-1 extends out further from fasteners 15 than second end 232 so as easily indicate to the operator which end of runner bar 23 is to be inserted into tool 11 (thereby ensuring that surface 25-1 of each stub 25 is facing in the proper direction for indexing by tool 11).

It should be noted that tool 11 is not limited to receiving fastener clip 13. Rather, it is to be understood that tool 11 is adapted to receive alternative types of fastener clips without departing from the spirit of the present invention. As an example, tool 11 is adapted to receive a modification of fastener clip 13 in which connector posts 27-2 are eliminated, thereby disconnecting successive cross-bars 21.

As noted briefly above, tool 11 is particularly well-suited for use in dispensing individual plastic fasteners 15 from clip 13 and into one or more desired objects. In particular, tool 11 is well-suited for use in dispensing individual plastic fasteners 15 into a dress shirt or the like in order to retain the dress shirt in a folded condition. Tool 11 comprises a hollow, gun-shaped housing 29, an anvil assembly 31 for supporting the desired items throughout the dispensing process, a trigger assembly 33 for actuating the dispensing process, a needle assembly 35 for selectively penetrating the desired items, an ejection mechanism 37 for ejecting desired individual plastic fasteners 15 through needle assembly 35 and into the desired items, and an indexing mechanism 39 for feeding the lead fastener 15 of clip 13 into proper alignment within housing 29 prior to the ejection process. It should be noted that portions of tool 11 not pertinent to this invention are neither shown nor described in detail herein.

Figure 2:
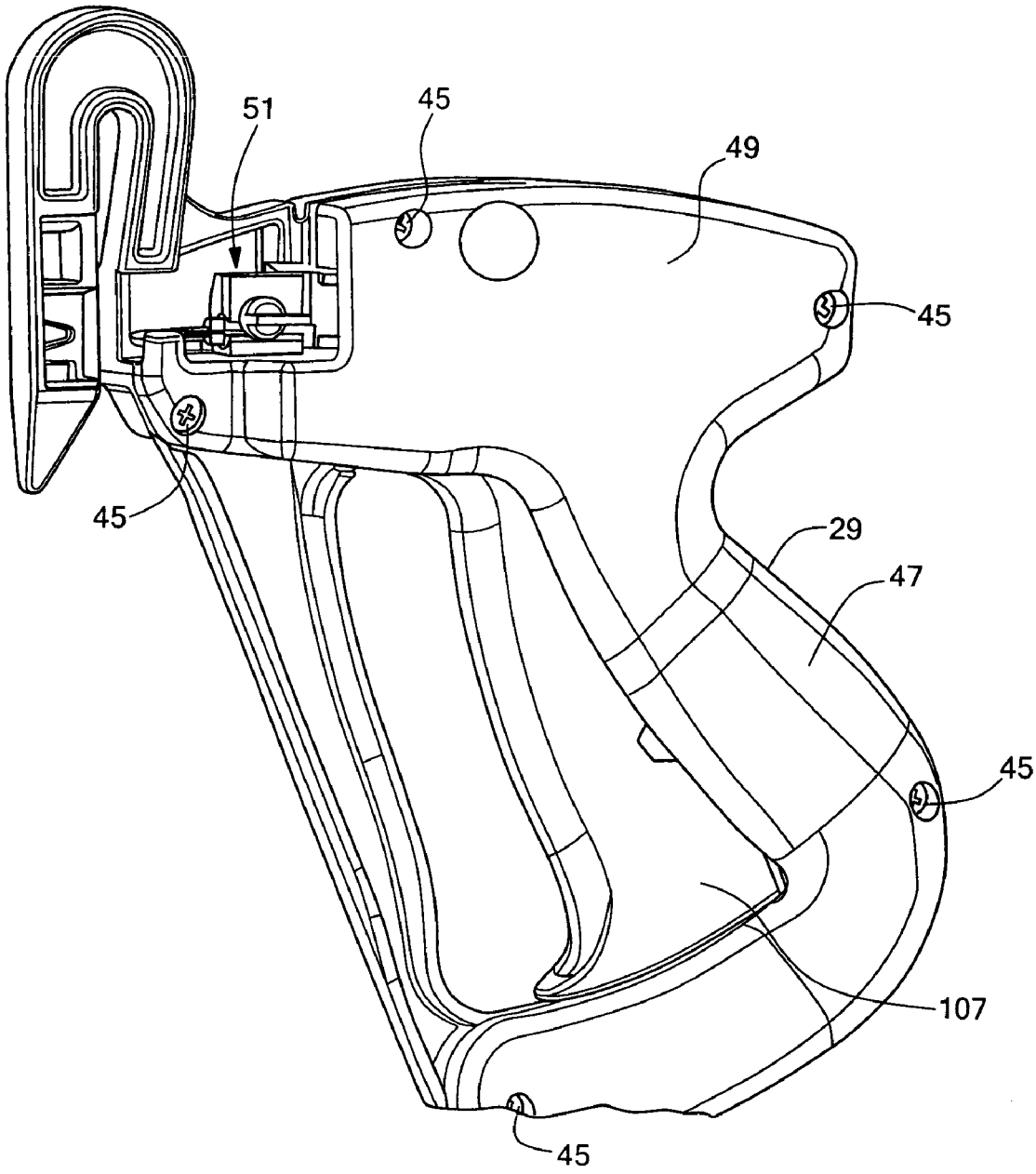
FIG. 2 is a fragmentary, front left top perspective view of the tool shown in FIG. 1, with the brush not being shown.
Figure 3:
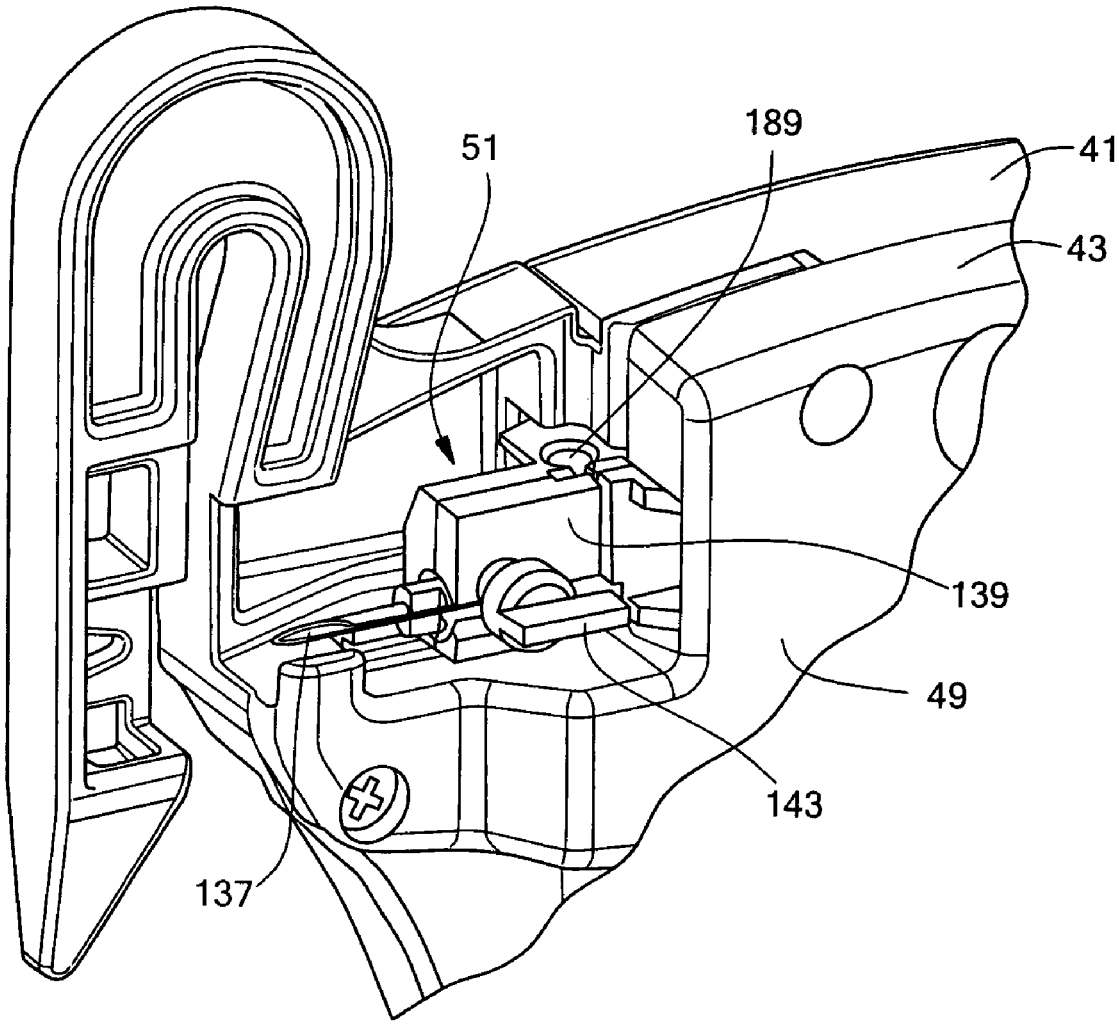
FIG. 3 is an enlarged, fragmentary, front left top perspective view of the tool shown in FIG. 1, with the brush not being shown.
Figure 13:
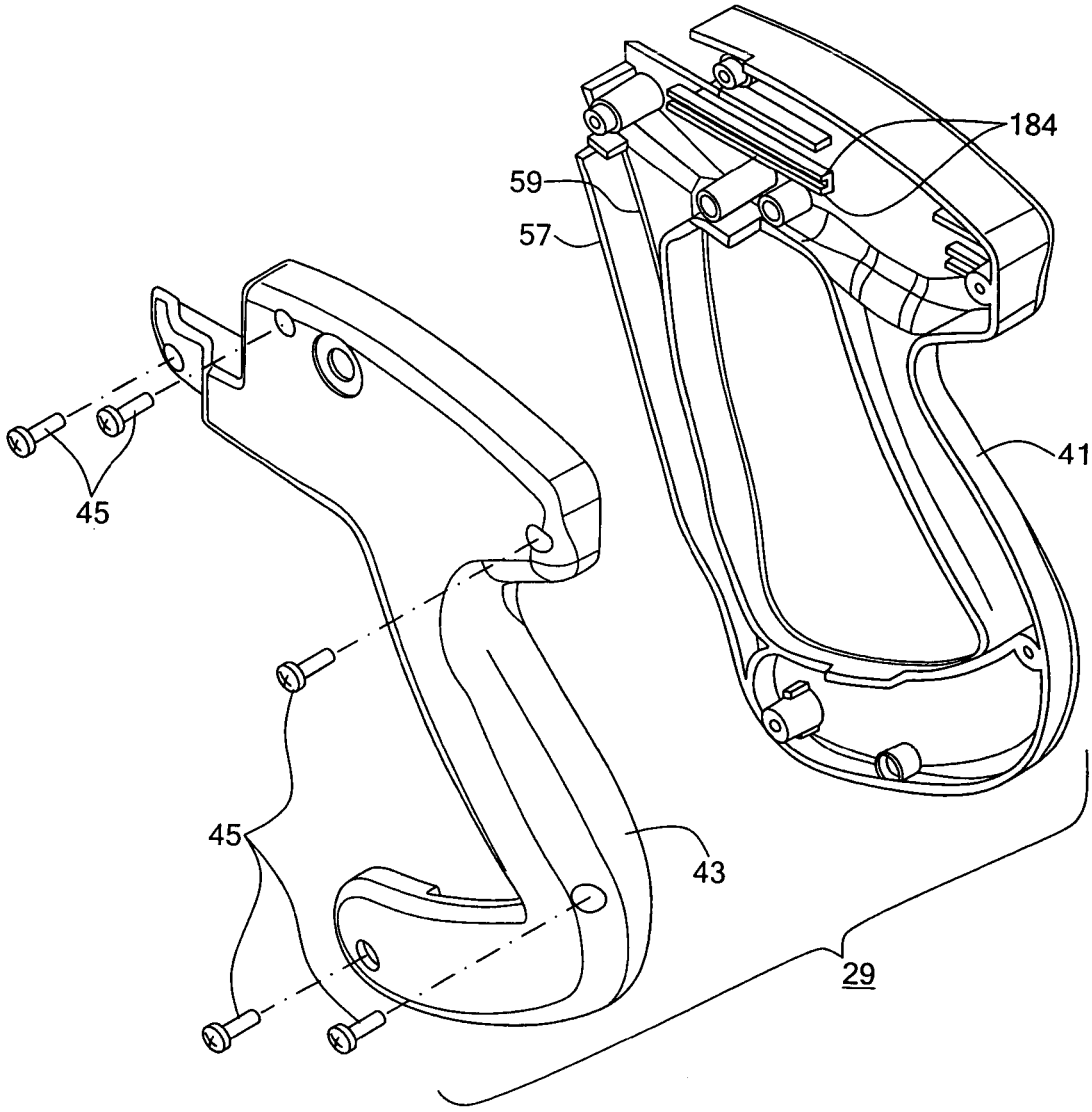
FIG. 13 is an exploded, left rear top perspective view of the housing of the tool shown in FIG. 1.
Figure 15A:
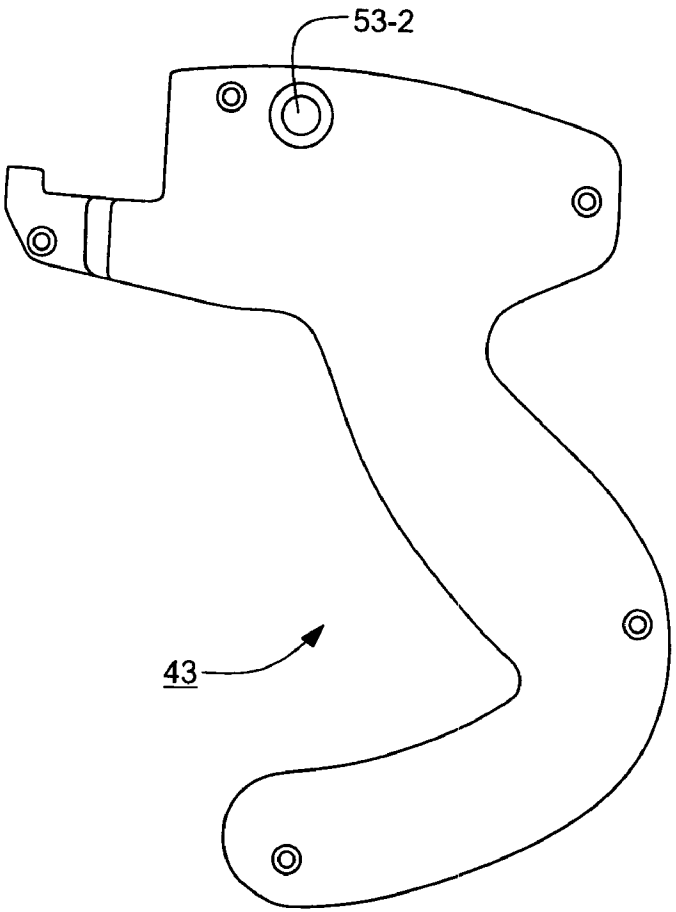
FIGS. 15(*a*) and 15(*b*) are left side and right side views, respectively, of the left half of the housing shown in FIG. 13.
Figure 15B:
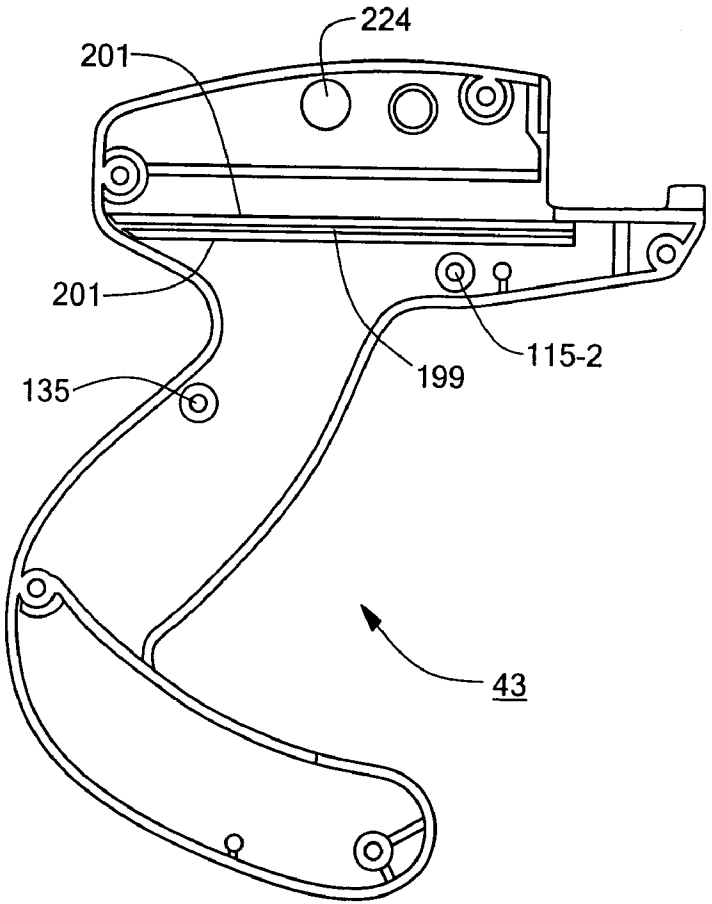

As seen most clearly in FIG. 13, housing 29 comprises a right half 41 (which is shown separately in FIG. 15(*a*) and FIG. 15(*b*)). Halves 41 and 43, which may be fabricated from any convenient durable material, such as molded polycarbonate, are joined together by a plurality of screws 45 and jointly define a handle portion 47 and a barrel portion 49, as seen most clearly in FIGS. 1-3. Right half 41 and left half 43 also jointly define an opening 51 located at the front of barrel portion 49, the purpose of opening 51 to be discussed below.

Figure 14A:
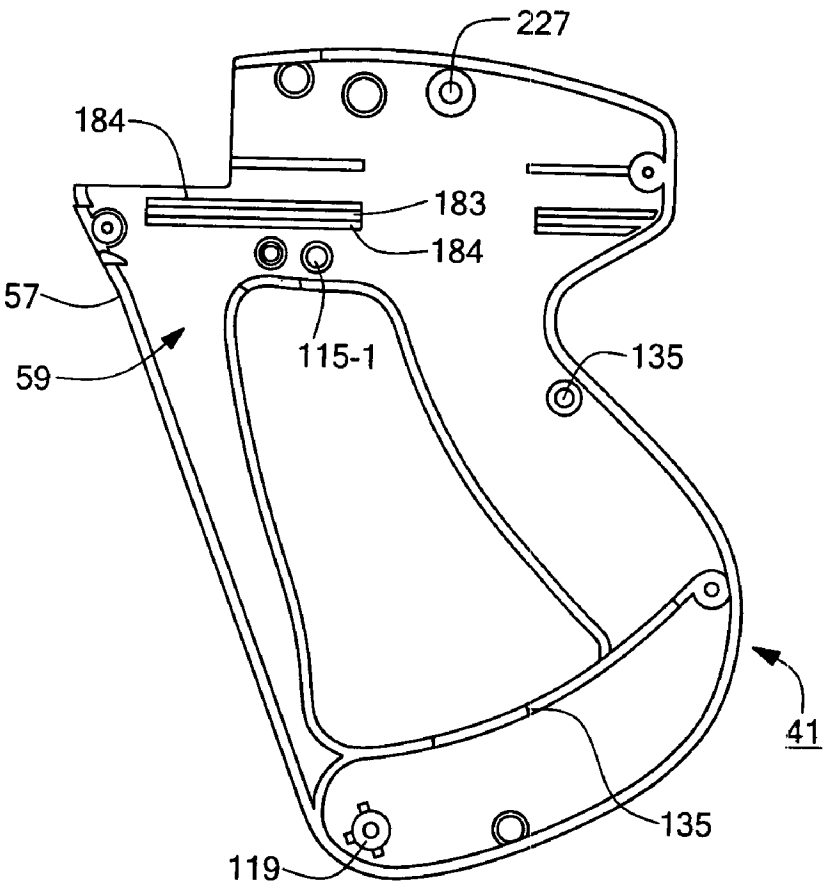
FIGS. 14(*a*) and 14(*b*) are left side and right side views, respectively, of the right half of the housing shown in FIG. 13.
Figure 14B:
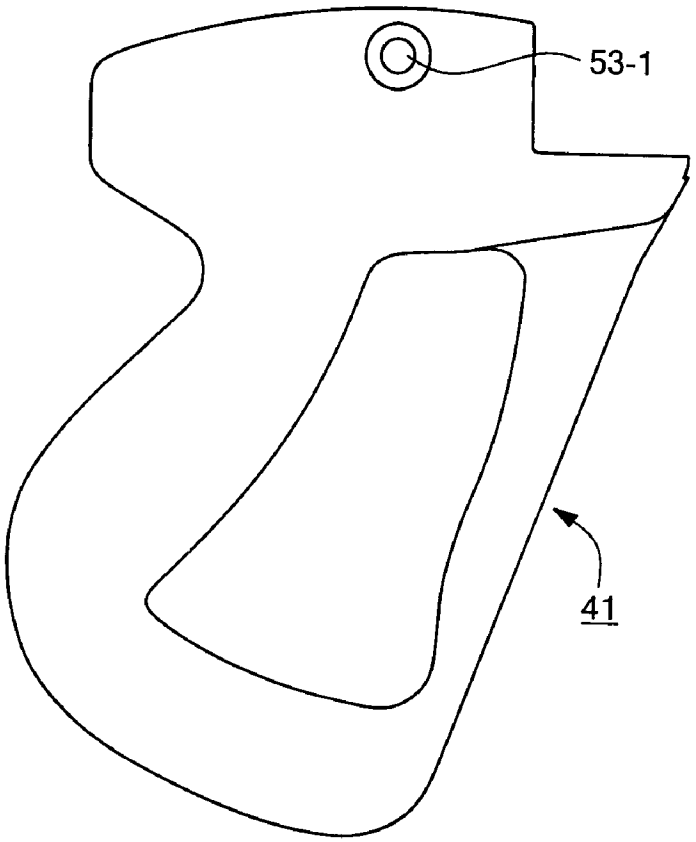

As seen most clearly in FIGS. 14(*b*) and 15(*a*), a circular opening 53-1 is provided in the barrel portion of right half 41 and a corresponding circular opening 53-2 is provided in the barrel portion of left half 43. Openings 53-1 and 53-2 are adapted to fittingly receive complementary-shaped bumper buttons 55-1 and 55-2, respectively. Buttons 55-1 and 55-2 are preferably constructed out of rubber so as to provide a outer gripping surface which prevents tool 11 from sliding across a working surface when placed thereon, which is highly desirable.

As seen most clearly in FIGS. 13 and 14(*a*), right half 41 of housing 29 is shaped to include a three-sided funnel 57. Funnel 57 is generally U-shaped in lateral cross-section and extends downwardly from the front of its barrel portion. Funnel 57 is shaped to define an inwardly tapered runner bar guide channel 59. As can be appreciated, funnel 57 is adapted to receive the used portion of a runner bar 23 after individual plastic fasteners 15 are severed therefrom during the dispensing process. In this capacity, funnel 57 serves to safely guide the used portion of the runner bar within channel 59, thereby directing the runner bar away from the hands of the operator and away the one or more items which are being fastened, which is highly desirable. Due to its U-shaped configuration, funnel 57 provides the operator with direct access to guide channel 59 through its open side, thereby enabling the operator to easily discard a used runner bar contained therewithin, if desired.

Figure 16:
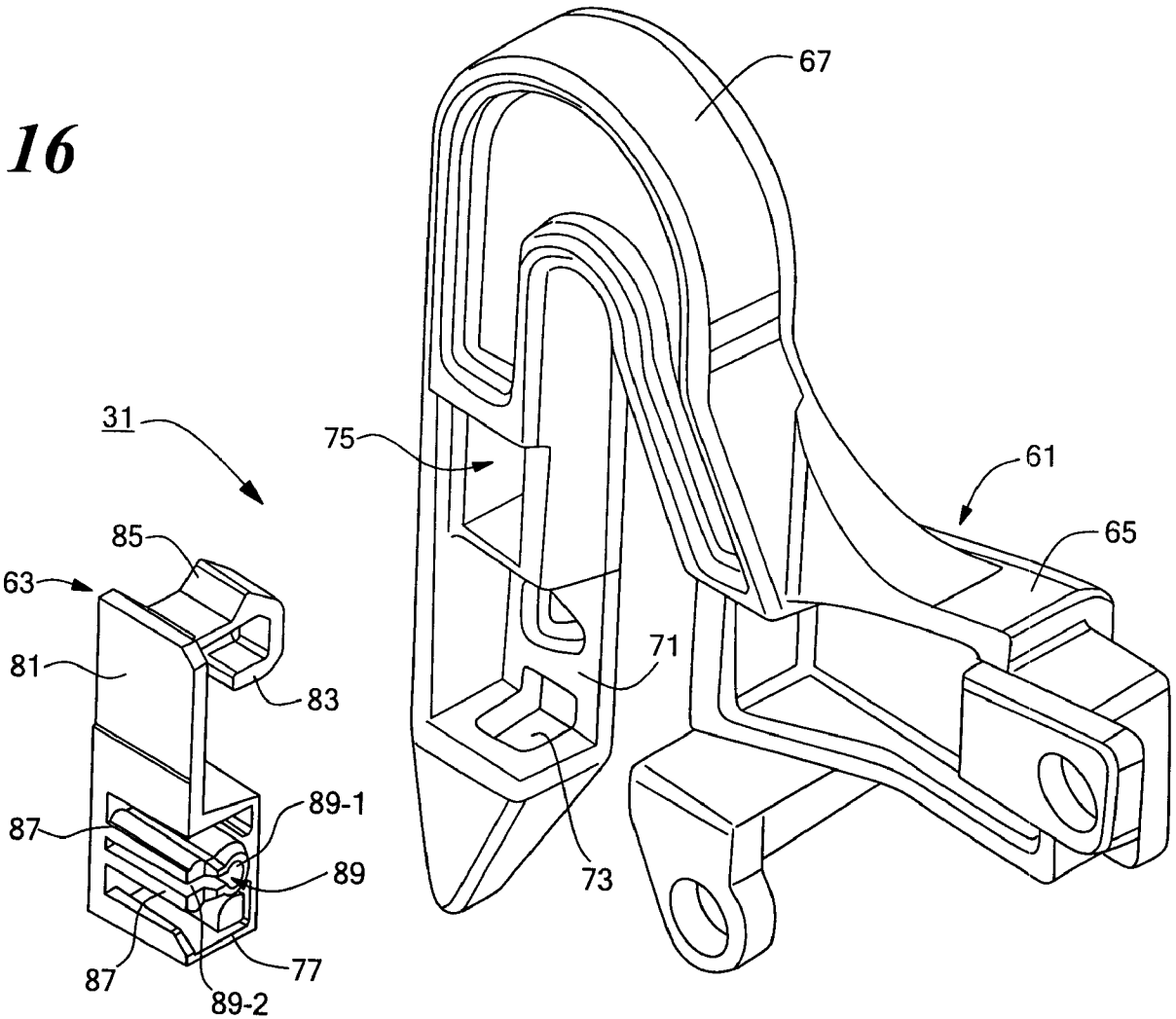
FIG. 16 is an enlarged, exploded, left rear top perspective view of the anvil assembly of the tool shown in FIG. 1.

Referring now to FIG. 16, anvil assembly 31 comprises an anvil 61 and a brush 63.

Anvil 61, which is preferbly molded of a rigid and durable material such as cast zinc, includes a rear portion 65 and a front portion 67. Rear portion 65 is disposed within barrel portion 49 of housing 29 and is secured to halves 41 and 43 by a pair of screws 45 which additionally serve to secure together right and left halves 41 and 43 of housing 29. Front portion 67 has a hook-type configuration. Specifically, front portion 67 extends upwardly from the top of housing 29 and then loops downwardly in front of tool 11 spaced a short distance from opening 51.

Front portion 67 is recessed along a portion of its length so as to define a substantially flat shelf 71 which is aligned with opening 51 in housing 29. A notch, or groove, 73 is formed into front portion 67 along the periphery of flat shelf 71. Front portion 67 is also shaped to define an opening 75 which is disposed directly above shelf 71. Together, shelf 71, notch 73 and opening 75 receive brush 63, as will be described further below.

Brush 63 is an integral piece which is adapted to be removably mounted onto front portion 67 of anvil 61. Brush 63, which is preferably made of molded nylon or the like, is shaped to include a partially hollowed block 77 which is sized and shaped to be fittingly received on shelf 71. A small protrusion 79 (which can be seen in FIG. 12) extends downward from the outer surface of block 77 and is sized and shaped to be fittingly received within notch 73. Furthermore, a support arm 81 extends upward from the outer surface of block 77. A finger 83 extends orthogonally out from support arm 81, finger 83 being shaped to include an engagement surface 85 which is in the form of a ratchet-shaped tooth.

Brush 63 is capable of being removably mounted onto front portion 67 of anvil 61 in the following manner. Specifically, brush 63 is orientated so that protrusion 79 on brush 63 projects into notch 73 formed in anvil 61. With protrusion 79 inserted into notch 73, block 77 of brush 63 is pivoted towards shelf 71. As block 77 is pivoted towards shelf 71, finger 83 is caused to articulate slightly inward by anvil 61 until finger 83 projects into opening 75. Continued rotation of brush 63 eventually causes finger 83 to project entirely through opening 75. Once finger 83 projects entirely through opening 75, finger 83 resiliently returns to its original configuration, which is evidenced by an audible snap. With finger 83 disposed as such, engagement surface 85 on finger 83 is drawn in contact against anvil 61, thereby securing brush 63 in place on anvil 61. In order to remove brush 63 from anvil 61, finger 83 is pivoted slightly inward until engagement surface 85 is disposed within opening 75 and out of engagement with anvil 61. Having disengaged surface 85 from anvil 61, finger 83 can be backed out of opening 75 and brush 63 can be separated from anvil 61. As can be readily appreciated, the ability to mount and dismount brush 63 onto anvil 61 allows for various types of replacement brushes to be mounted onto anvil 61 when deemed necessary, which is highly desirable.

A single pair of elongated filaments 87 are formed onto block 77 and are integrally formed together at one end. Filaments 87 are sized, shaped and spaced apart from one another at their free ends so as to define a keyhole-shaped opening 89 in lateral cross-section therebetween. Keyhole-shaped opening 89 includes a circular portion 89-1 in lateral cross-section which is sized and shaped to receive the sharpened tip of the needle for tool 11 and a rectangular portion 89-2 in lateral cross-section which is in communication with circular portion 89-1.

As such, with brush 63 securely mounted onto anvil 61, brush 63 is disposed in direct alignment with opening 51 in housing 29 and is adequately spaced from tool 11 so that circular portion 89-1 of opening 89 receives the tip of the needle for tool 11 during the forward trigger stroke thereof. In this manner, anvil assembly 31 not only serves as a support during the fastening operation to be performed by tool 11 but also serves to protect a user from inadvertently contacting the sharpened tip of the needle of tool 11 during the forward trigger stroke thereof.

Brush 63 is shown herein as comprising a pair of filaments 87 which are configured in such a manner so as to define a single keyhole-shaped opening 89 therebetween. Each filament 87 has a thickness and rigidity which precludes displacement of its free end upon the application of a significant lateral force. However, it is to be understood that brush 63 is not limited to the number, size, shape and configuration of filaments 87 as shown herein. Rather, the filaments of brush 63 could be modified in number, size, shape and/or configuration without departing from the spirit of the present invention.

As an example, brush 63 could be modified without departing from the spirit of the present invention to include a plurality of filaments (e.g., six filaments) which are configured in such a manner so as to define a single opening therebetween which is generally oval in lateral cross-section, each filament being generally circular in lateral cross-section along its length and of a thickness to allow its free end to be slightly displaced upon the application of a significant lateral force.

As another example, brush 63 could be modified without departing from the spirit of the present invention to include a first pair of elongated filaments which are spaced considerably apart, each of said first pair of filaments having a thickness and rigidity which precludes displacement of its free end upon the application of a significant lateral force, and a second comprises a pair of elongated filaments which are disposed between the first pair of filaments, each of the second pair of filaments being arcuate in lateral cross-section and having thickness and rigidity which allows for the considerable displacement of its free end upon the application of a significant lateral force. The second pair of filaments define an opening which is circular in lateral cross-section, the opening being sized and shaped to receive the sharpened tip of the needle during the forward trigger stroke of tool 11.

Figure 17:
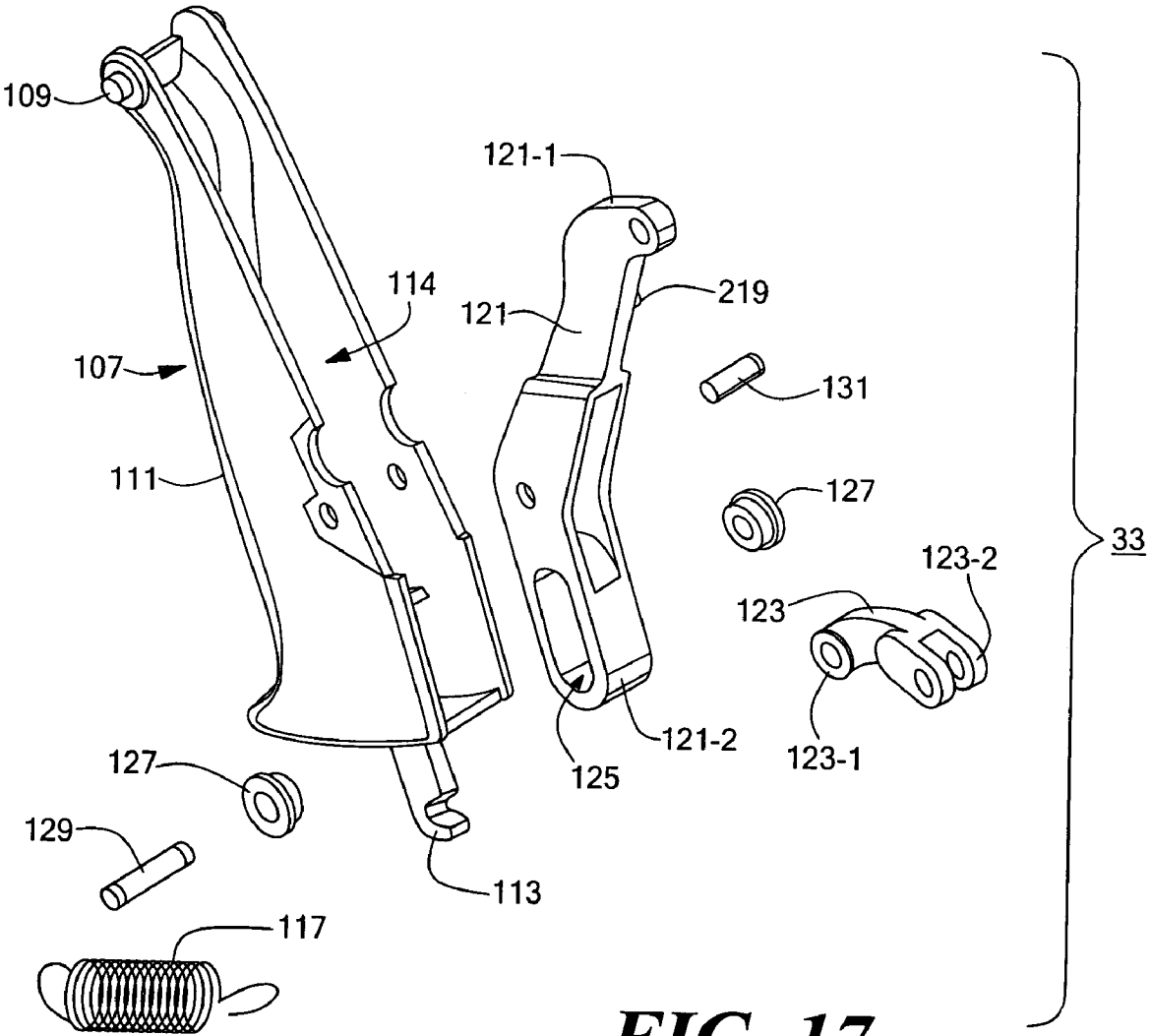
FIG. 17 is an enlarged, exploded, left rear top perspective view of the trigger assembly of the tool shown in FIG. 1.

As seen most clearly in FIG. 17, trigger assembly 33 comprises a trigger 107 which is made of molded plastic or another similarly suitable material. Trigger 107 includes an integrally formed pin 109, an elongated ergonomically-shaped, finger actuation surface 111, and an integrally formed, downwardly extending, hook-shaped finger 113. In addition, trigger 107 is partially hollowed out so as define an interior trigger cavity 114 therewithin.

First and second trigger post receptacles, or bosses, 115-1 and 115-2 are integrally formed onto halves 41 and 43, respectively, and are each sized and shaped to receive a corresponding end of pin 109. In this capacity, trigger 107 is pivotally attached to housing 29 about pin 109.

Actuation surface 111 is elongated and ergonomically-shaped to conform with the shape of the fingers of the user. Surface 111 extends partially through an opening formed in the handle portion 47 of housing 29. In this capacity, actuation surface 111 is exposed for digital manipulation by the operator.

A coiled trigger spring 117 is attached at one end onto hook-shaped finger 113 and is attached at its opposite end onto a raised boss 119 which is integrally formed onto right half 41 of housing 29. In this manner, spring 117 serves to continuously bias trigger 107 in the forward direction away from the rear wall of handle portion 47.

Trigger assembly 33 additionally includes a trigger link 121 and an idler link 123, both of which may be made of molded plastic (such as MINLON) or another suitable material.

Trigger link 121 is an elongated unitary member which includes a first end 121-1 and a second end 121-2, second end 121-2 being shaped to define an elongated slot 125. A pair of link rollers 127 are pivotally mounted onto trigger 107 about a dowel pin 129. Link rollers 127 are positioned within trigger cavity 114 and are disposed to project into slot 125 of trigger link 121. Positioned as such, rollers 127 are capable of rotatably traveling within slot 125 in trigger link 121.

Figure 12:
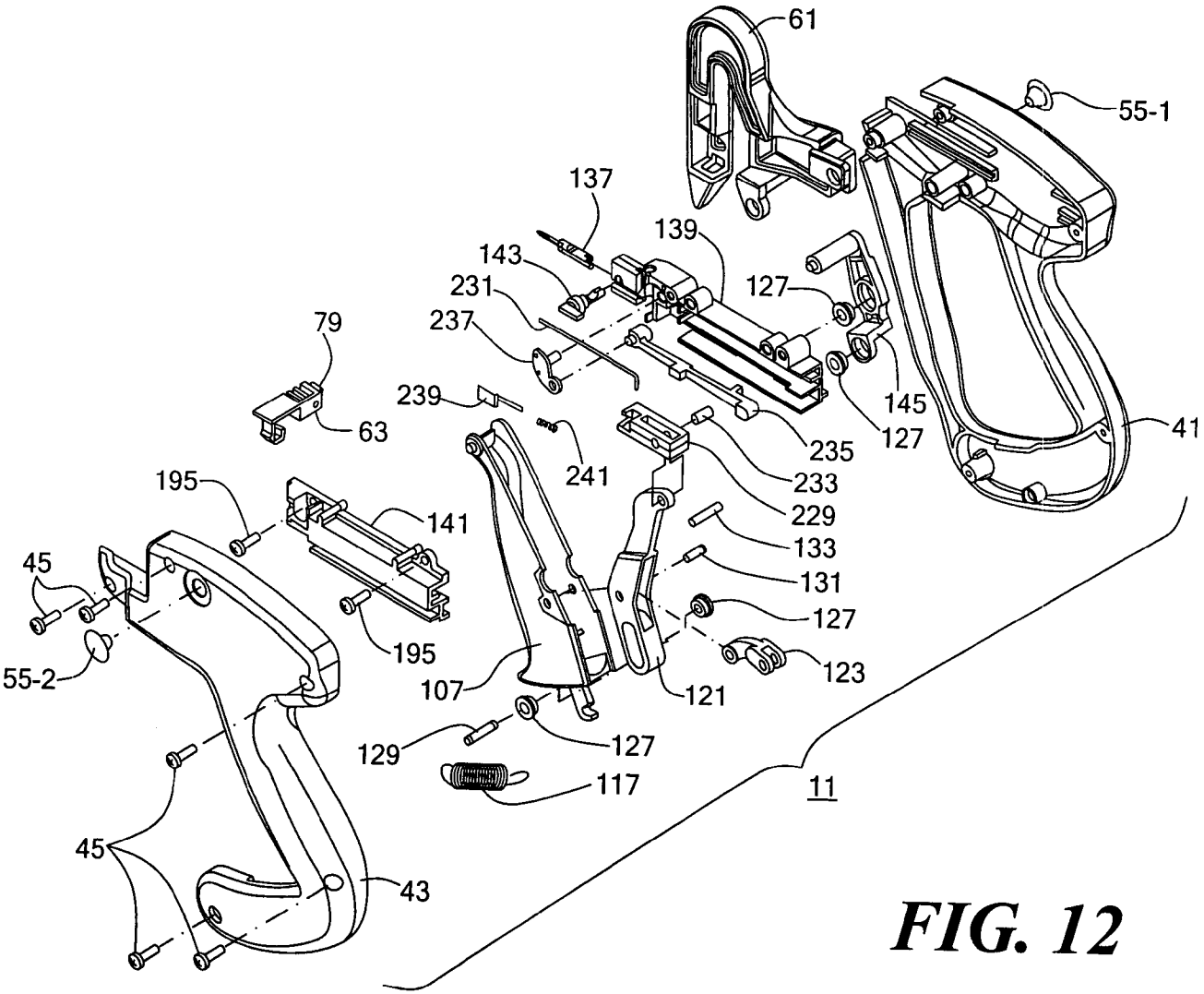
FIG. 12 is an exploded, left rear top perspective view of the tool shown in FIG. 1.

Idler link 123 is a curved unitary member which includes a first end 123-1 and a second end 123-2. First end 123-1 of idler link 123 is pivotally coupled to the approximate midpoint of trigger link 121 about a dowel pin 131. In addition, a dowel pin 133 (which is shown in FIG. 12) is mounted onto second end 123-2 of idler link 123. Each end of dowel pin 133 is and is sized and shaped to be fittingly disposed within a corresponding boss 135 formed in halves 41 and 43. In this manner, idler link 123 can pivot about dowel pin 133.

In use, trigger assembly 33 functions in the following manner. Specifically, trigger 107 is resiliently urged forward about pin 109 by trigger spring 117 until the front surface of hooked-shaped finger 113 abuts against a trigger stop 135 which is integrally formed into right half 41 of housing 29. Upon the application of an inward force onto actuation surface 111, trigger 107 pivots inward about pin 109 which, in turn, causes link rollers 127 to apply an inward force onto trigger link 121 as link rollers 127 slide upward within slot 125. The inward force applied to second end 121-2 of trigger link 121 causes trigger link 121 to pivot in a counterclockwise direction about dowel pin 131. Upon release of the inward force onto actuation surface 111, trigger spring 117 resiliently urges trigger 107 outward until hooked-shaped finger 113 abuts against trigger stop 135, thereby returning trigger assembly 33 to its original position.

Figure 18:
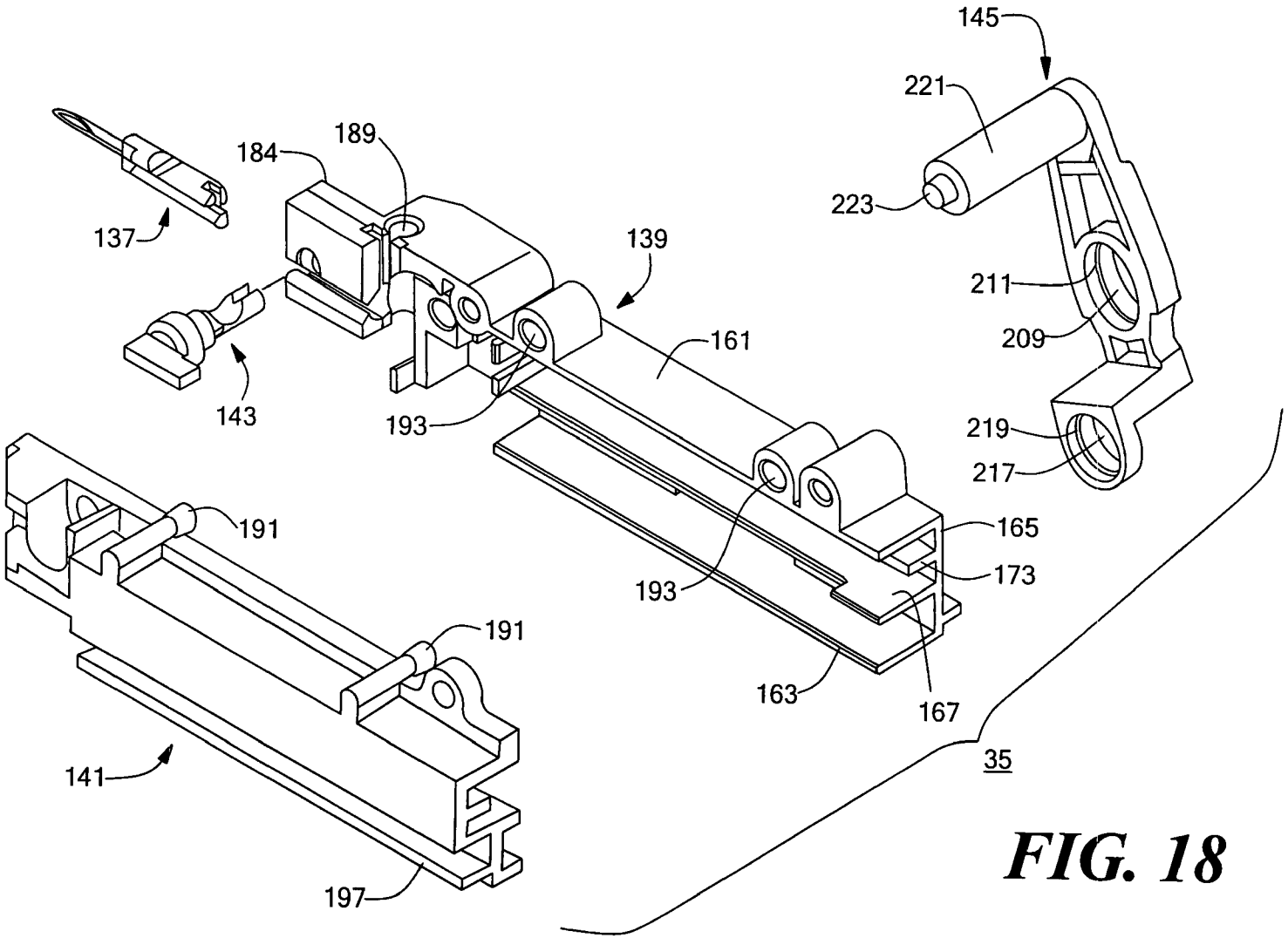
FIG. 18 is an enlarged, exploded, left rear top perspective view of the needle assembly of the tool shown in FIG. 1.

Needle assembly 35 is slidably mounted within housing 29 and selectively penetrates through the desired objects to be fastened using tool 11, as will be described further in detail below. Referring now to FIG. 18, needle assembly 35 comprises a needle 137, a needle slide 139 for holding needle 137, a needle slide cover 141 removably mounted onto needle slide 139, a needle lock 143 for releasably locking needle 137 within needle slide 139 and a needle slide link 145 for coupling needle slide 139 to trigger assembly 33.

Figure 19:
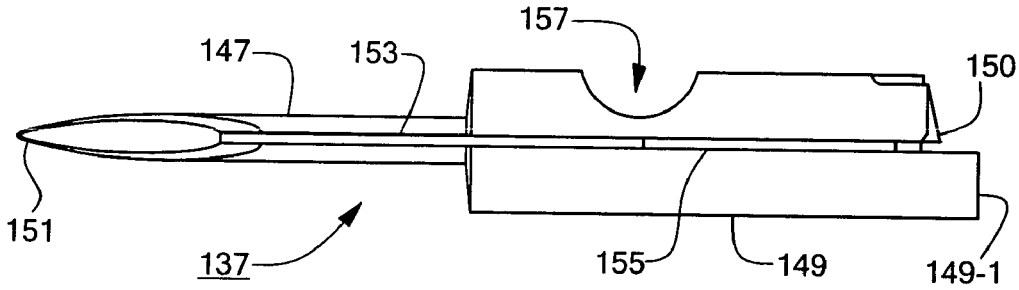
FIG. 19 is an enlarged, left side view of the needle shown in FIG. 18.
Figure 22:
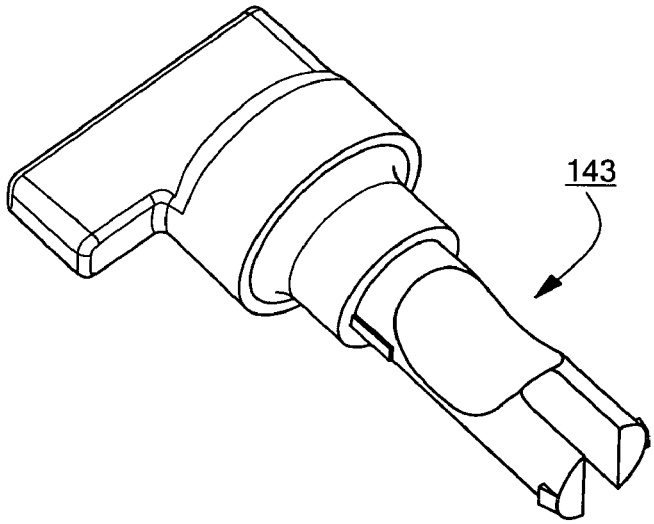
FIG. 22 is an enlarged, rear top right side view of the needle lock shown in FIG. 18.
Figure 20A:
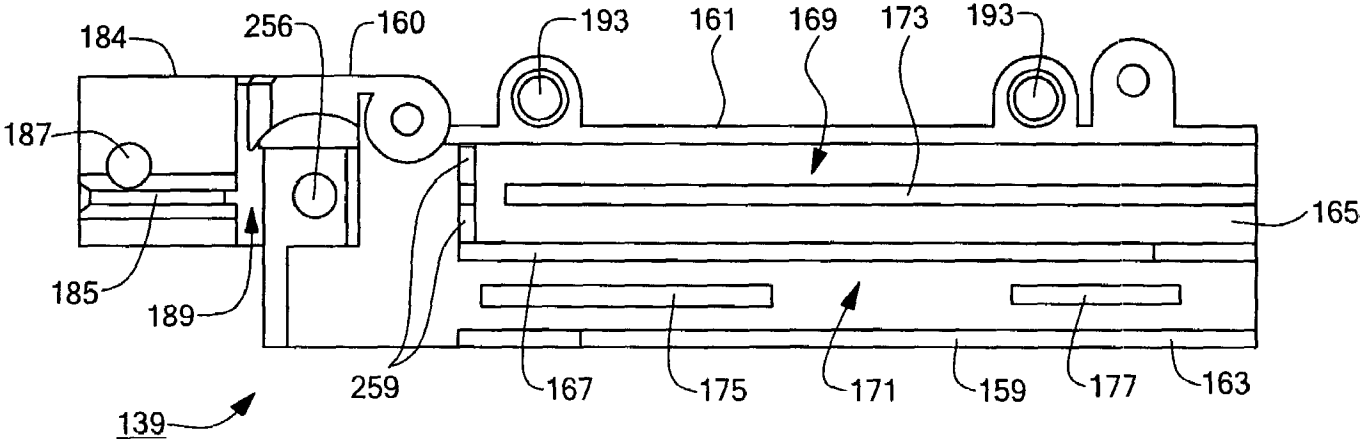
FIGS. 20(*a*) and 20(*b*) are left side and right side views, respectively, of the needle slide shown in FIG. 18.
Figure 20B:
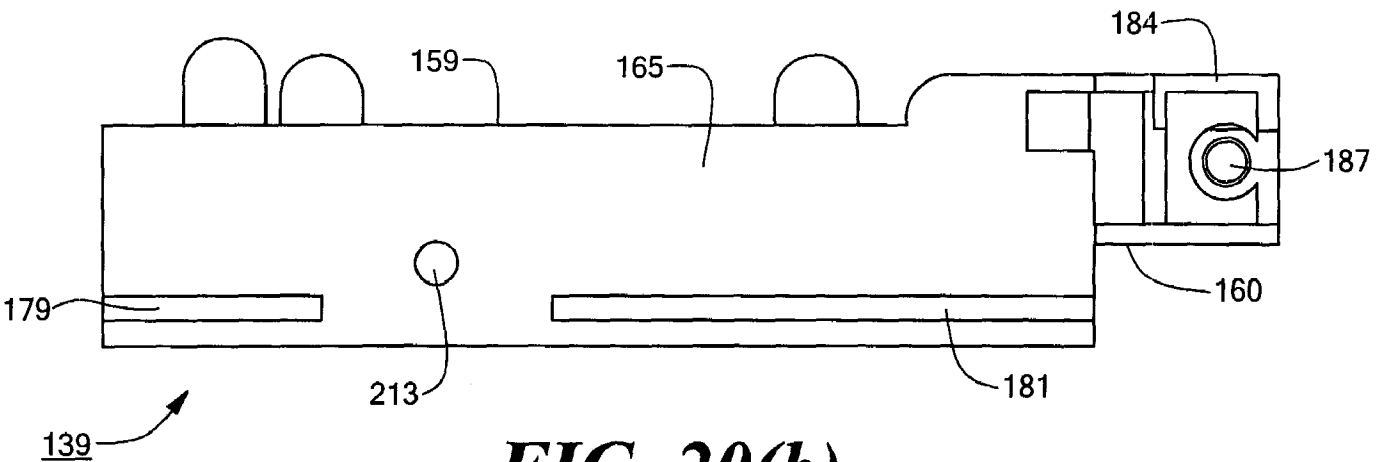

As seen most clearly in FIG. 19, needle 137 comprises a stem portion 147 and a base portion 149. Stem portion 147, which may be made from stamped and rolled metal, is a generally cylindrical member terminating at one end in a sharpened tip 151 which is designed for insertion through a garment or like object. Stem portion 147 also has a slotted bore 153 extending longitudinally therethrough. Base portion 149 may be made of a plastic that has been insert-molded onto that end of stem portion 147 that is distal to tip 151. (Alternatively, stem portion 147 and base portion 149 may be a unitary structure made of metal or another suitable material.) Base portion 149 is provided with a slotted longitudinal bore 155 that is aligned with bore 153 of stem portion 147. Base portion 149 is also provided with a scalloped-shaped recess 157 on its outer surface whose purpose will be described further below. The bores of stem portion 147 and base portion 149 are appropriately dimensioned so that the cross-bar 19 of a fastener 15 may be inserted thereinto from the rear of base portion 149, traverse the length of needle 137 through bore 153 of stem portion 147 and then exit needle 137 through sharpened tip 151. The slots of stem portion 147 and base portion 149 are appropriately dimensioned to permit filament 17 of fastener 15 to extend therethrough while its associated cross-bar 19 remains disposed within needle 137, said slots being orientated in tool 11 so as to face towards left half 43 of housing 29.

Preferably, the base portion 149 of needle 137 is shaped to include a tapered anti-back surface 149-1 at its rear end for preventing clip 13 from jamming within tool 11, as will be described further below. Furthermore, the rear surface of stem portion 147 includes a sharpened knife blade 150 for severing stub 25 during the ejection process, which will be described further below.

It should be noted that the particular construction of needle 137 does not serve as a principal feature of the present invention. Rather, it is to be understood that needle 137 represents any conventional tagger gun needle which includes a scalloped-shaped recess and a knife blade. For example, needle may be of the type disclosed in the commonly owned U.S. application Ser. No. 10/006,779, which was filed on Nov. 5, 2001 in the name of William J. Cooper et al. and which is incorporated herein by reference.

Figure 21A:
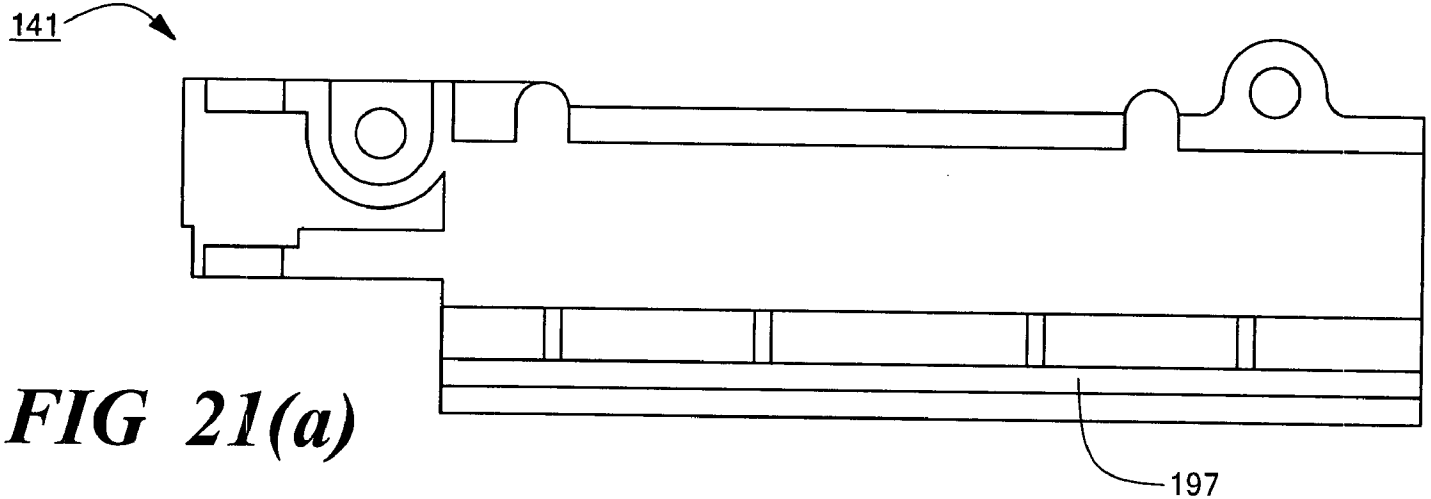
FIGS. 21(*a*) and 21(*b*) are left side and right side views, respectively, of the needle slide cover shown in FIG. 18.
Figure 21B:
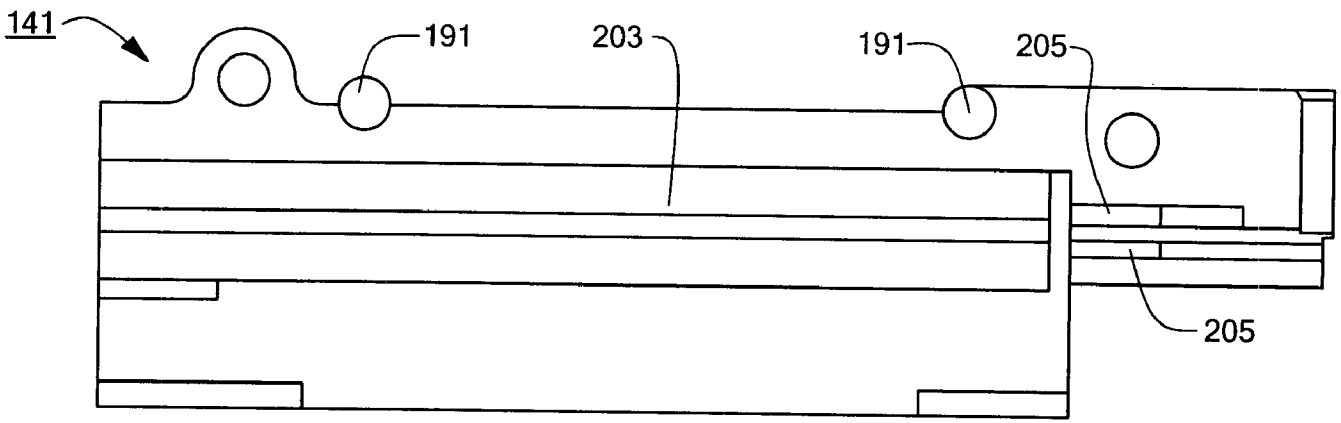

As seen most clearly in FIGS. 21(*a*) and 21(*b*), needle slide 139 is an elongated unitary member which may be molded of plastic (e.g., polycarbonate) or another suitable material. Needle slide 139 comprises a rear portion 159 and a front portion 160.

Rear portion 159 includes a top wall 161 and a bottom wall 163 which extend orthogonally out from opposite ends of a side wall 165. A partition 167 extends orthogonally out from sidewall 165 at the approximate midpoint between top wall 161 and bottom wall 163. Partition 167 extends in parallel with top wall 161 and bottom wall 163 so as to define an ejector slide channel 169 between top wall 161 and partition 167 and so as to define a feed slide channel 171 between partition 167 and bottom wall 163. A support rib 173 extends orthogonally out from sidewall 165 and into ejector slide channel 169 at the approximate midpoint between top wall 161 and partition 167. Similarly, a pair of spaced apart, co-linear, support ribs 175 and 177 extend orthogonally out from sidewall 165 and into feed slide channel 171 at the approximate midpoint between partition 167 and bottom wall 163.

A pair of spaced apart, co-linear, longitudinally-extending, guiding ribs 179 and 181 extend orthogonally out from the outer surface of sidewall 165. Guiding ribs 179 and 181 are sized and shaped to be fittingly received within a slot 183 defined at least in part by a pair of spaced apart, parallel, longitudinally extending ribs 184 which are integrally formed onto right half 41 of housing 29. In this capacity, ribs 184 serve to limit needle slide 139 to linear displacement within barrel portion 49 of housing 29.

Front portion 160 is shaped to include a forward extending nose 184. A needle receiving bore 185 extends longitudinally in from the front end of nose 184, needle receiving bore 185 being generally circular in lateral cross-section. In addition, a needle lock receiving bore 187 extends laterally across nose 184 of needle slide 139, needle lock receiving bore 187 being disposed directly above and extending orthogonally in relation to needle receiving bore 185, for reasons to become apparent below. Furthermore, a fastener clip bore 189 extends vertically down through the rear of nose 184, fastener clip bore 189 being sized and shaped to receive a portion of fastener clip 13 (namely, runner bar 23, stubs 25 and cross-bars 19 of fastener clip 13).

As seen most clearly in FIGS. 21(*a*) and 21(*b*), needle slide cover 141 is an elongated unitary member which may be molded of plastic (e.g., polycarbonate) or another suitable material. Needle slide cover 141 includes a pair of posts 191 which are sized and shaped to press fit into an associated pair of bosses 193 which are integrally formed onto rear portion 159 of needle slide 139 in order to mount needle slide cover 141 onto needle slide 139. Needle slide cover 141 is secured in its mounted position on needle slide 139 by a pair of screws 195.

A longitudinally extending guiding rib 197 extends orthogonally out from the outer surface of needle slide cover 141. Guiding rib 197 is sized and shaped to be fittingly received within a slot 199 defined at least in part by a pair of spaced apart, parallel, longitudinally extending ribs 201 which are integrally formed onto left half 43 of housing 29. In this capacity, ribs 201 serve to limit needle slide cover 141 to linear displacement within barrel portion 49 of housing 29.

Needle slide cover 141 is shaped to define an ejector slide channel 203 in its inner surface. In addition, a pair of parallel, spaced apart, longitudinally extending ribs 205 extend out from the inner surface of needle slide cover 141. Together, ejector slide channel 203 and ribs 205 serve to limit ejection mechanism 37 to linear displacement, as will be described further in detail below.

Base portion 149 of needle 137 is sized and shaped to fit snugly within needle receiving bore 185 in needle slide 139. However, base portion 149 of needle 137 is capable of sliding longitudinally within needle receiving bore 185, thereby enabling needle 137 to be either mounted into or removed from needle slide 139, as desired. In this capacity, needle 137 may be removed and replaced with similar needles, as deemed necessary by the operator. As such, if needle 137 becomes dulled or broken during use, the operator can replace needle 137 with a new needle, thereby extending the life of tool 11, which is highly desirable.

However, in order to properly dispense a fastener 15 into one or more desired objects, needle 137 must first be fixedly secured in place within bore 185 of needle slide 139 during the dispensing process. Accordingly, the function of needle lock 143 is to releasably secure, or lock, needle 137 in place within bore 185 of needle slide 139, as will be described further below.

Preferably, needle lock 143 is of the type described in commonly owned U.S. patent application Ser. No. 10/209,300, which was filed on Jul. 31, 2002 in the name of Jeffrey A. Raymond, said application being incorporated herein by reference. In particular, needle lock 143 is preferably of the type which is adapted to be snap-fit into bore 185, with needle lock 143 engaging needle slide 139 in such a manner so as to permanently secure needle lock 143 in its mounted position within needle slide 139. By permanently mounting needle lock 143 within needle slide 139, the operator is precluded from inadvertently losing, damaging or misplacing needle lock 143.

In use, needle lock 143 is capable of being rotated axially within bore 185 between a locked position in which needle lock 143 engages needle 137 so as to preclude removal of needle 137 from needle slide 139 and an unlocked position in which needle lock 143 disengages from needle 137 so as to allow needle 137 to be slidably removed from needle slide 139.

Figure 23A:
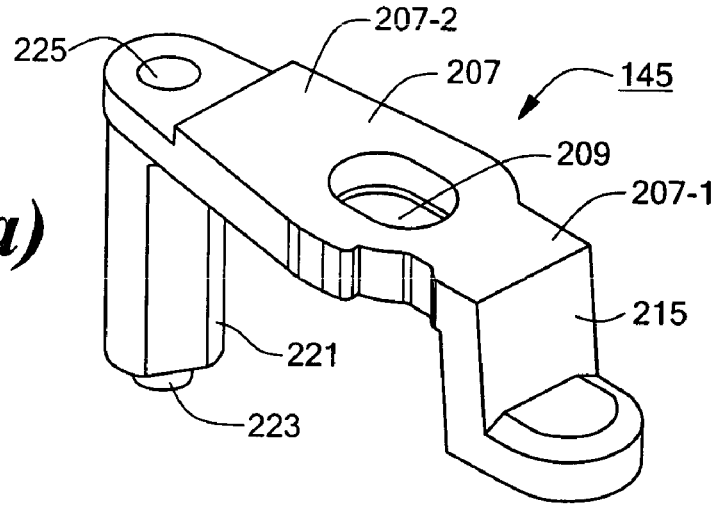
FIGS. 23(*a*) through 23(*c*) are enlarged, bottom rear right perspective, right side, and longitudinal section views, respectively, of the needle slide link shown in FIG. 18.
Figure 23B:
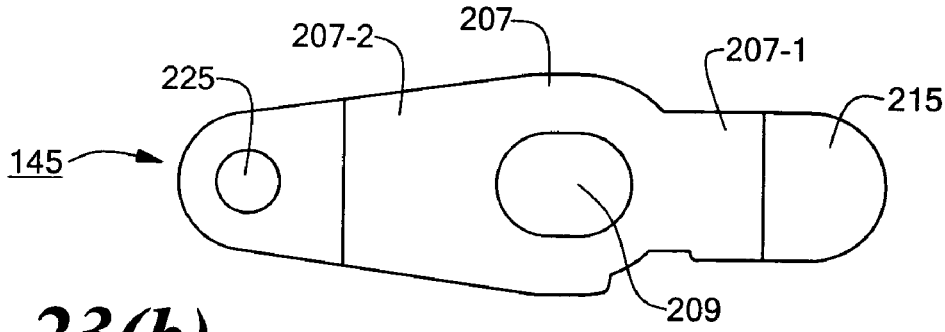
Figure 23C:
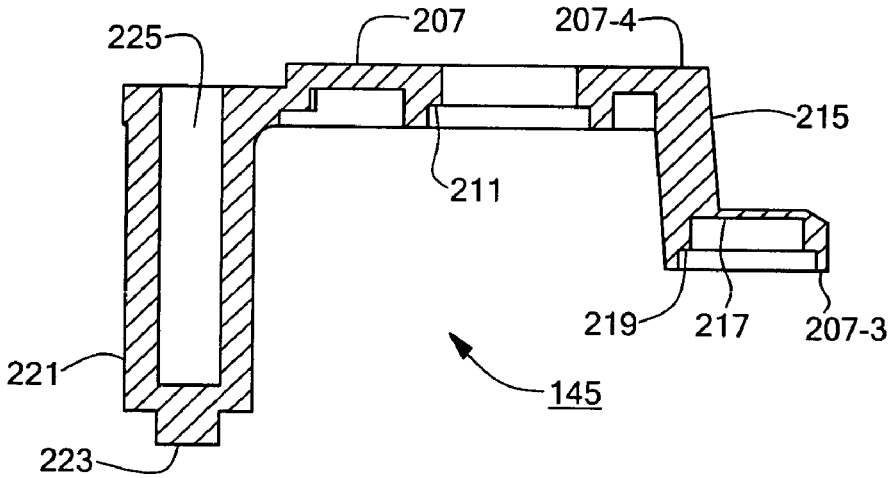
Figure 24:
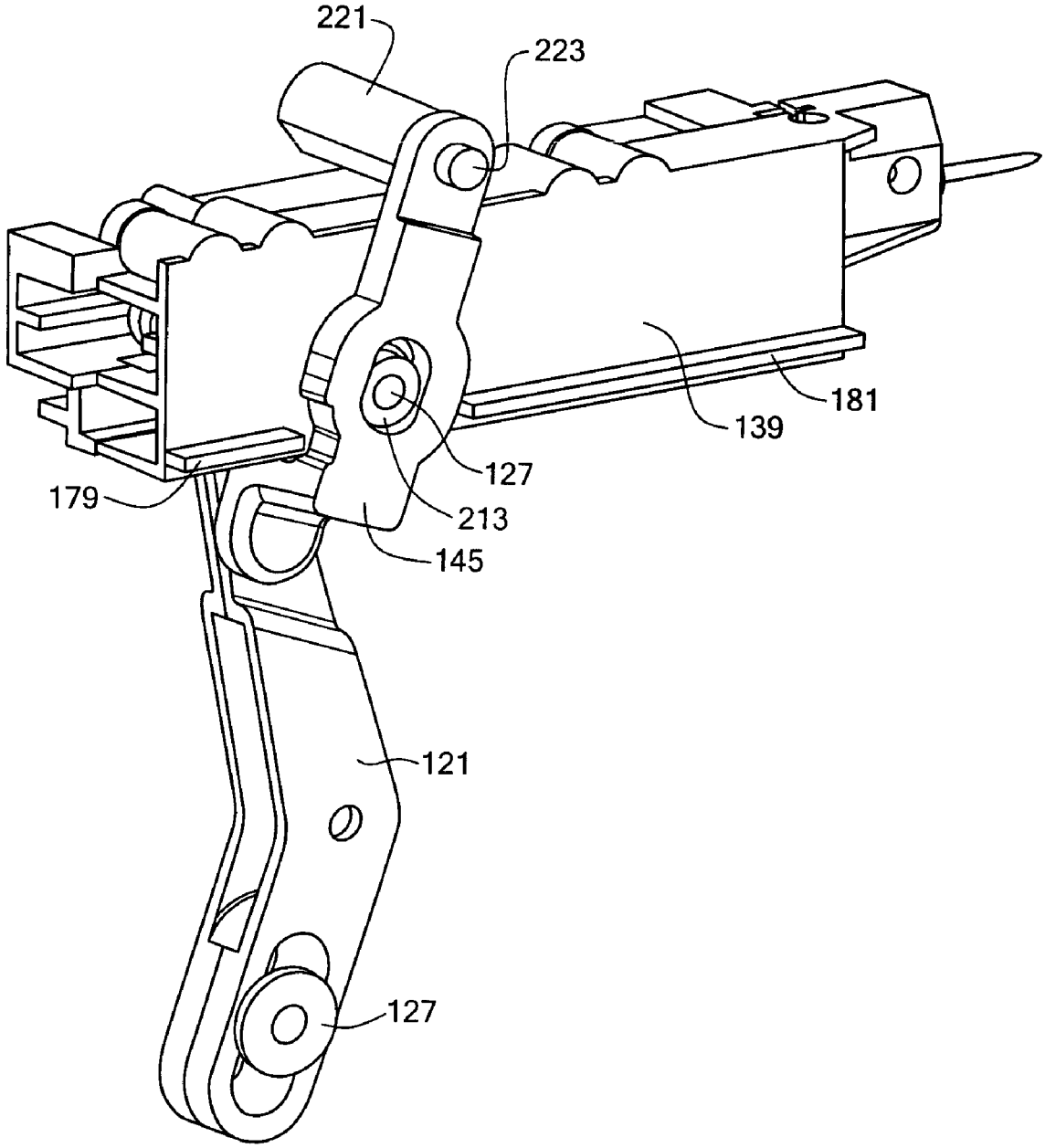
FIG. 24 is a right rear top perspective view of the needle assembly shown of the tool shown in FIG. 1.

As seen most clearly in FIGS. 23(*a*) through 23(*c*), needle slide link 145 is an elongated unitary member which may be molded of plastic (e.g., MINLON) or another suitable material. Needle slide link 145 comprises a center member, or arm, 207 which includes a first end 207-1, a second end 207-2, a first surface 207-3 and a second surface 207-4. Center member 207 is shaped to include an oval opening 209 at the approximate midpoint between first end 207-1 and second end 207-2. First surface 207-3 is countersunk at opening 209 so as to form an annularly-shaped shelf 211 around the periphery of opening 209. Shelf 211 is sized and shaped to support a link roller 127 which, in turn, is rotatably mounted onto a post 213 which is integrally formed onto and extends orthogonally out from the outer surface of sidewall 165 of needle slide 139, as seen most clearly in FIG. 24.

An L-shaped shoulder 215 is integrally formed onto first end 207-1 of needle slide link 145. Shoulder 215 extends orthogonally out from first surface 207-3 at first end 207-1. The free end of shoulder 215 is shaped to define a recessed platform 217, platform 217 being countersunk therearound so as to form a shelf 219. Shelf 219 is sized and shaped to support a link roller 127 which, in turn, is rotatably mounted onto a post 219 which is integrally formed onto and extends orthogonally out from trigger link 121.

An enlarged cylindrical post 221 is integrally formed onto and extends orthogonally out from first surface 207-3 at second end 207-2. The free end of post 221 is shaped to include a reduced-sized protrusion 223 which is sized and shaped to be received within a corresponding boss 224 which is integrally formed into left half 43 of housing 29. In addition, a circular recess 225 is formed into second surface 207-4 at second end 207-2 in axial alignment with protrusion 223. Recess 225 is sized and shaped to receive a corresponding post 227 which is integrally formed into right half 41 of housing 29. In this capacity, second end 207-2 is pivotally attached to right half 41 and left half 43 of housing 29.

Figure 4:
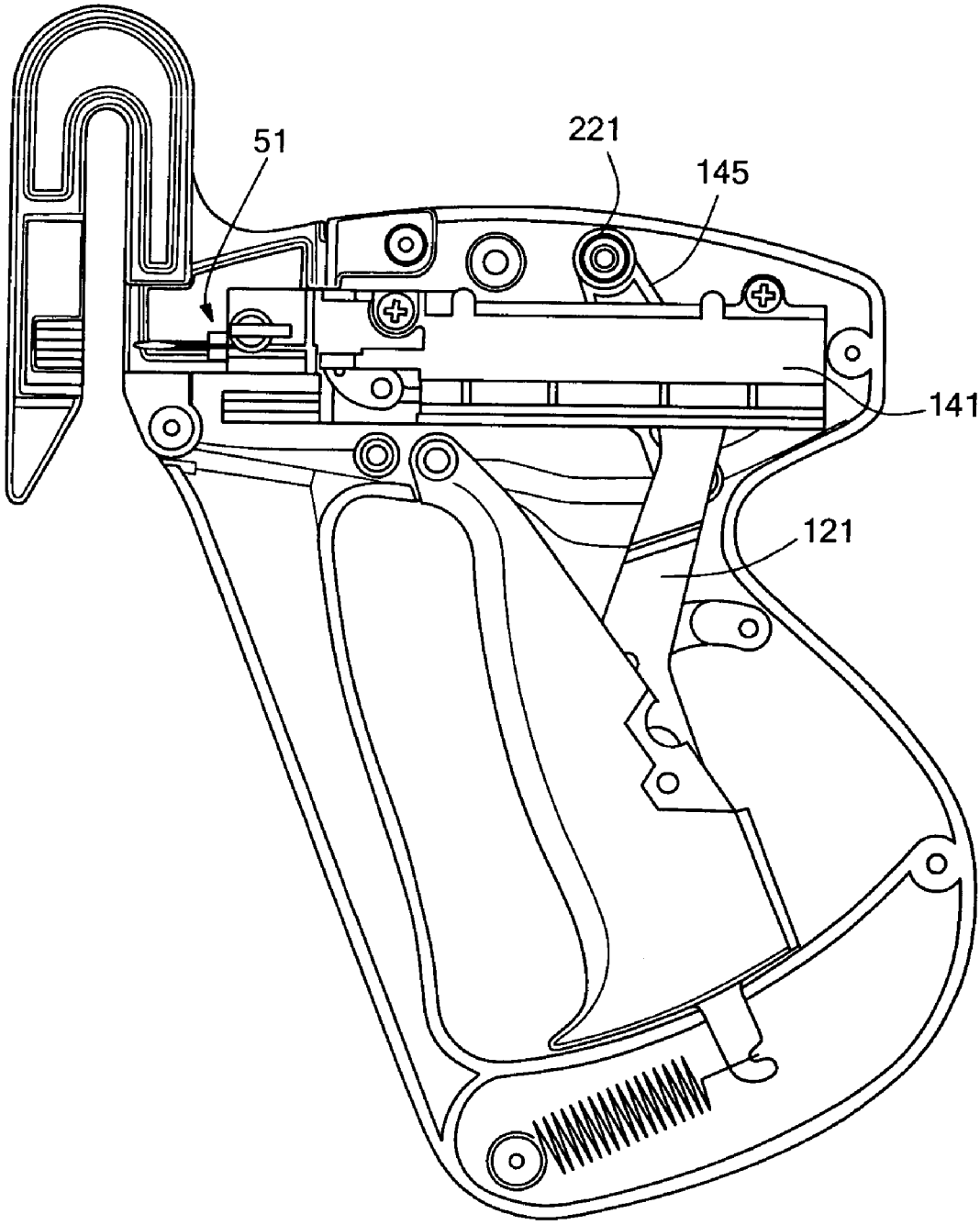
FIG. 4 is a left side view of the tool shown in FIG. 1, with the left half of the casing not being shown.
Figure 5:
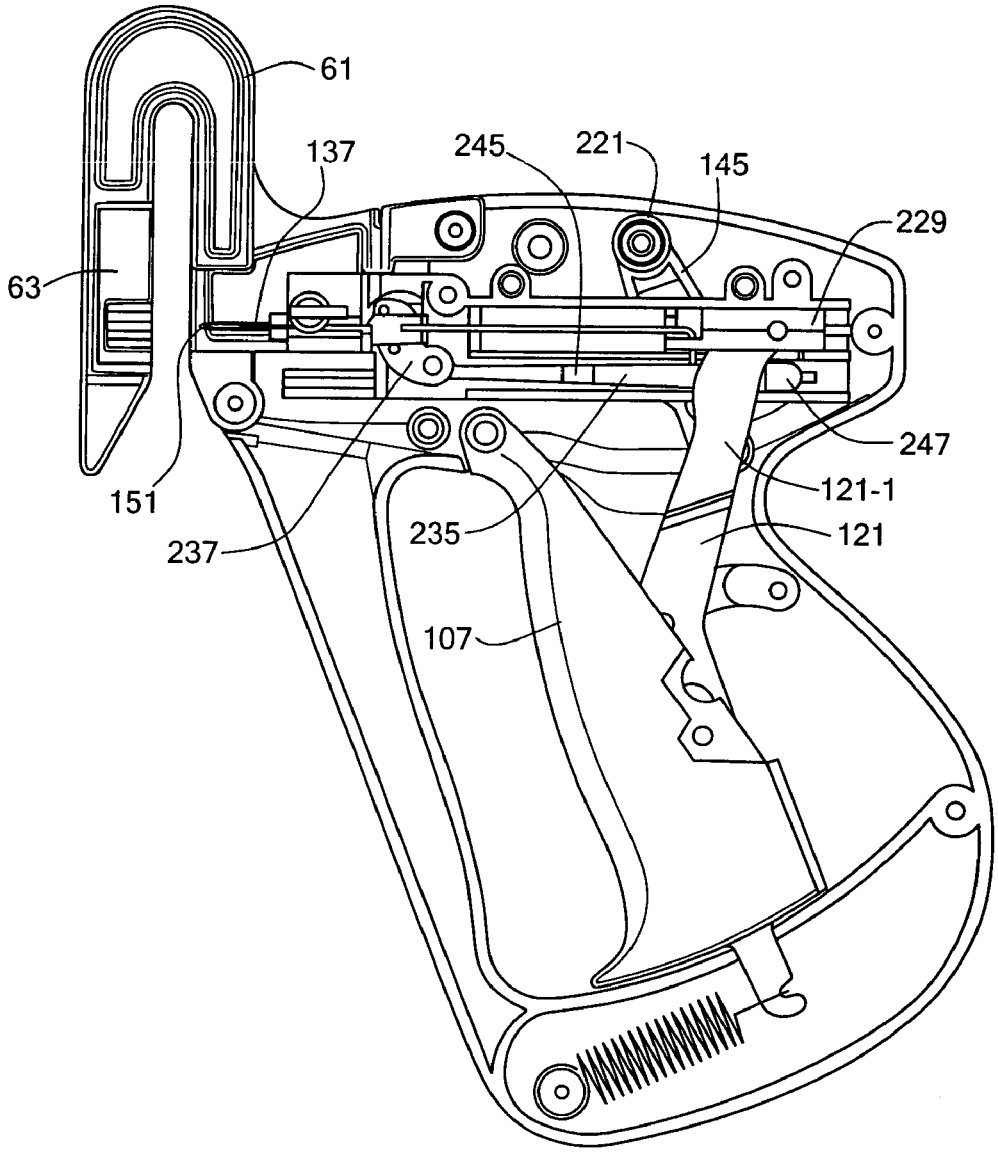
FIG. 5 is a left side view of the tool shown in FIG. 1, with the left half of the casing and the needle slide cover not being shown.
Figure 6:
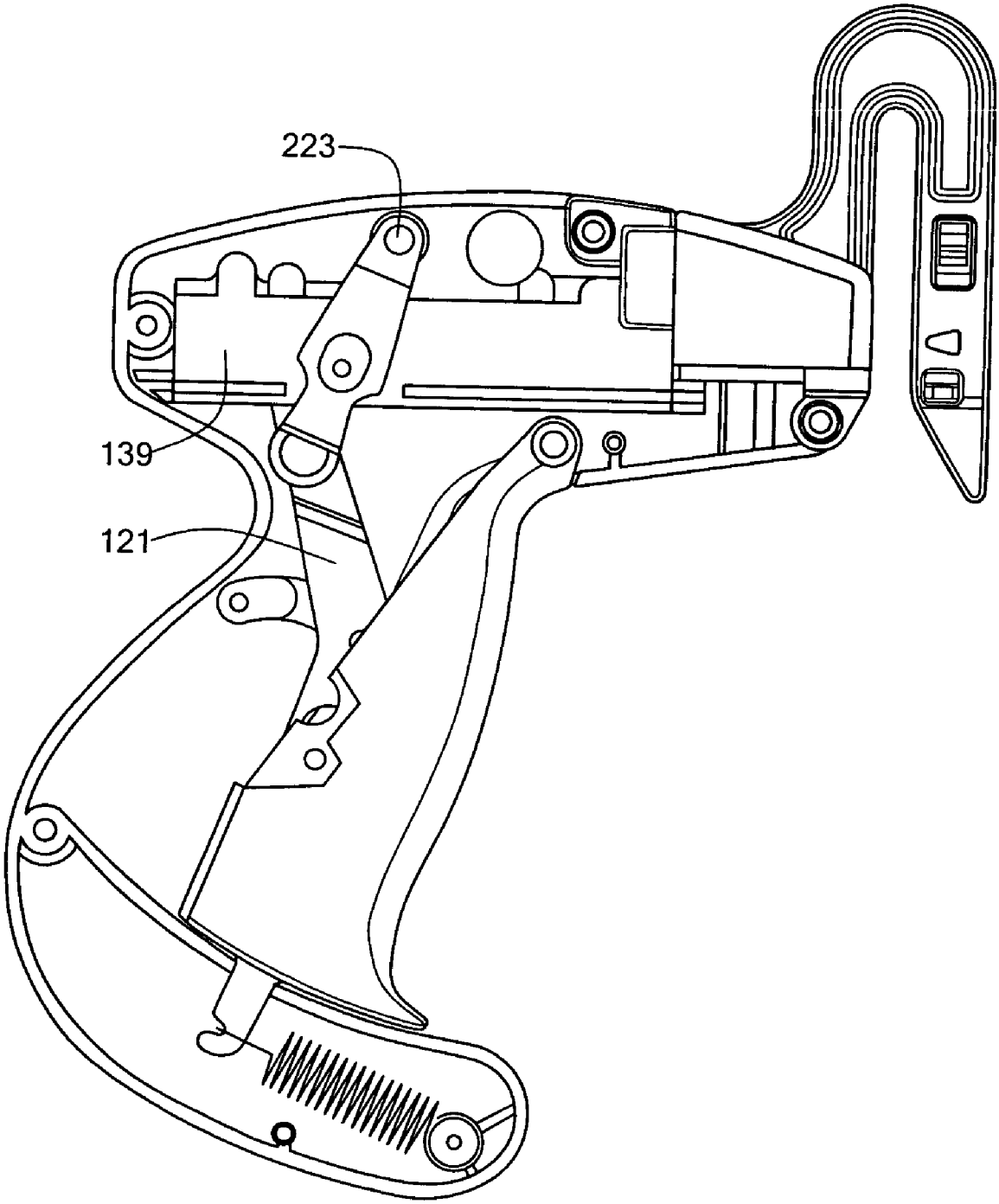
FIG. 6 is a right side view of the tool shown in FIG. 1, with the right half of the casing and the needle slide cover not being shown.

In use, needle assembly 35 functions in the following manner. In the absence of an application force on trigger 107, needle assembly 35 is disposed in its retracted position, as shown in FIGS. 4-6. With needle assembly 35 disposed in its retracted position, needle slide 139 is disposed in its most rearward position within barrel portion 49 with sharpened tip 151 of needle 137 remaining behind the front end of barrel portion 49 of housing 29. As an application force is applied onto trigger 107, trigger link 121 begins to rotate in the counterclockwise direction which, in turn, causes needle slide link 145 to pivot in the clockwise direction about post 221. The rotation of needle slide link 145 in the clockwise direction, in turn, drives needle slide 139 linearly forward out through opening 51 in housing 29. Upon completion of the forward trigger stroke of trigger assembly 33, needle assembly 35 is disposed in its extended position, with needle slide 139 disposed in its most forward position within barrel portion 49 and with sharpened tip 151 of needle 137 penetrating between filaments 87 of brush 63. Release of trigger 107 causes trigger assembly 33 and needle assembly 35 to return to their original positions.

Figure 25:
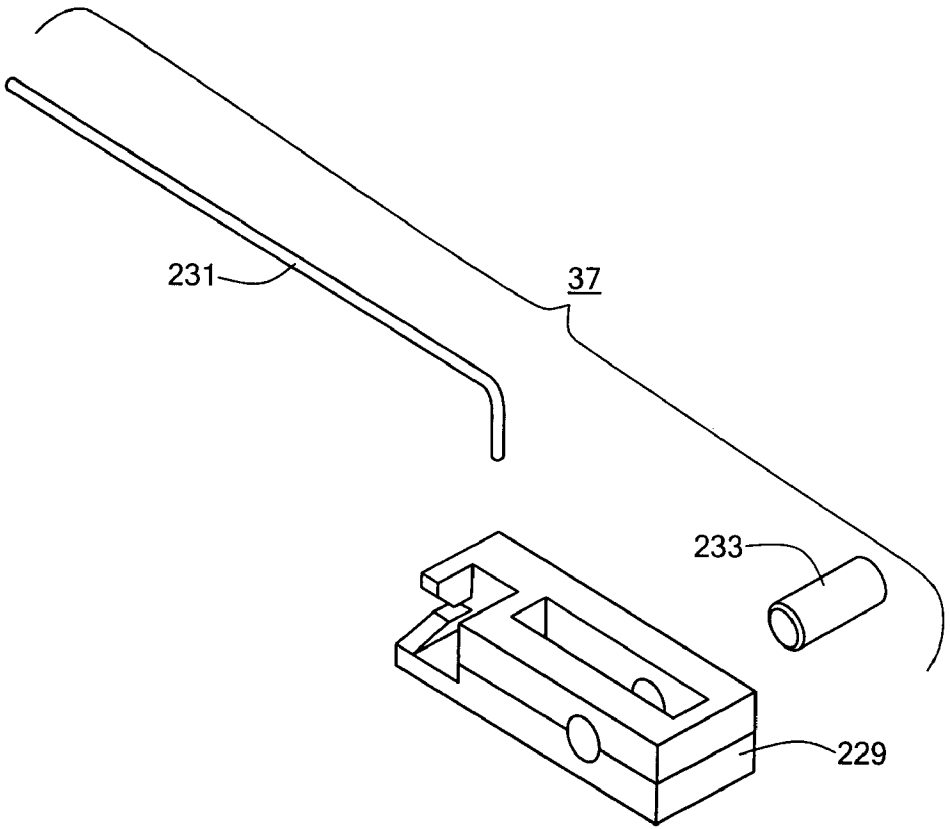
FIG. 25 is an enlarged, exploded, left rear top perspective view of the ejection mechanism of the tool shown in FIG. 1.

Ejection mechanism 37 is slidably mounted within housing 29 and serves to eject a desired plastic fastener 15 through hollowed needle 137 and into the one or more items to be fastened. As seen most clearly in FIG. 25, ejection mechanism 37 comprises an ejector slide 229 and an ejector rod 231.

Ejector slide 229, which may be made of molded plastic (e.g., DELRIN) or another suitable material, is slidably mounted between needle slide 139 and needle slide cover 141. Specifically, ejector slide 229 is slidably mounted within ejector slide channel 169 in needle slide 139 and within ejector slide channel 203 in needle slide cover 141.

Figure 26:
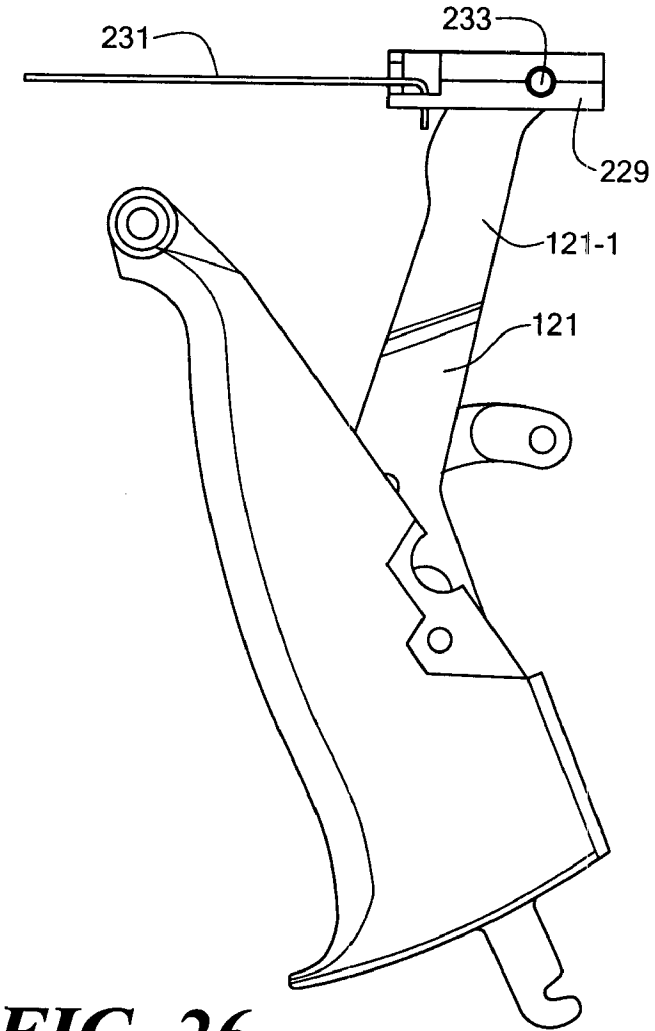
FIG. 26 is a right side view of the trigger assembly and ejection mechanism of the tool shown in FIG. 1.

As seen most clearly in FIG. 26, ejector slide 229 is coupled to first end 121-1 of trigger link 121 by means of a pin 233 that that is fixed to ejector slide 229, trigger link 121 being pivotally mounted on pin 233. In this manner, when trigger 107 is squeezed, ejector slide 229 is linearly displaced in the forward direction within ejector slide channel 169 in needle slide 139 and within ejector slide channel 203 in needle slide cover 141; conversely, when trigger 107 is released, ejector slide 229 is linearly displaced in the rearward direction within ejector slide channel 169 in needle slide 139 and within ejector slide channel 203 in needle slide cover 141.

Ejector rod 231 is preferably conventional in shape and composition. The rear end of ejector rod 231 is mounted in the front end of ejector slide 229, the front end of ejector rod 231 extending forwardly away from ejector slide 229 and being aligned with bore 153 of needle 137. In this manner, when trigger 107 is squeezed, ejector slide 229 and ejector rod 231 together move linearly forward through barrel portion 49 until the front end of ejector rod 231 in inserted into and through needle 137. Because, as will hereinafter be described, cross-bar 19 of the lead fastener 15 of a fastener clip 13 loaded in tool 11 is positioned behind bore 153 of needle 137, as the front end of ejector rod 231 moves linearly forward through barrel portion 49, it pushes said cross-bar 19 into and through needle 137. Pushing said cross-bar through needle 137 draws stub 25, which connects said cross-bar 19 to the common runner bar 23, against knife blade 150, thereby severing said stub. Furthermore, the forward linear force applied onto said cross-bar through needle 137 severs the connector post 27-1 which connects said cross-bar 19 to its adjacent cross-bar 19.

It should be noted that needle assembly 35 and ejection mechanism 37 are independently coupled to trigger assembly 33. In addition, needle assembly 35 and ejection mechanism 37 are independently slidably mounted in the barrel portion of 49 of tool 11. As a result, both needle assembly 35 and ejection mechanism 37 are capable of being independently slidably displaced through the barrel portion 49 of tool 11 solely through the activation of trigger assembly 33, thereby smoothing out the forward trigger stroke and simplifying the internal mechanics of tool 11, which are principal objects of the present invention.

Figure 27:
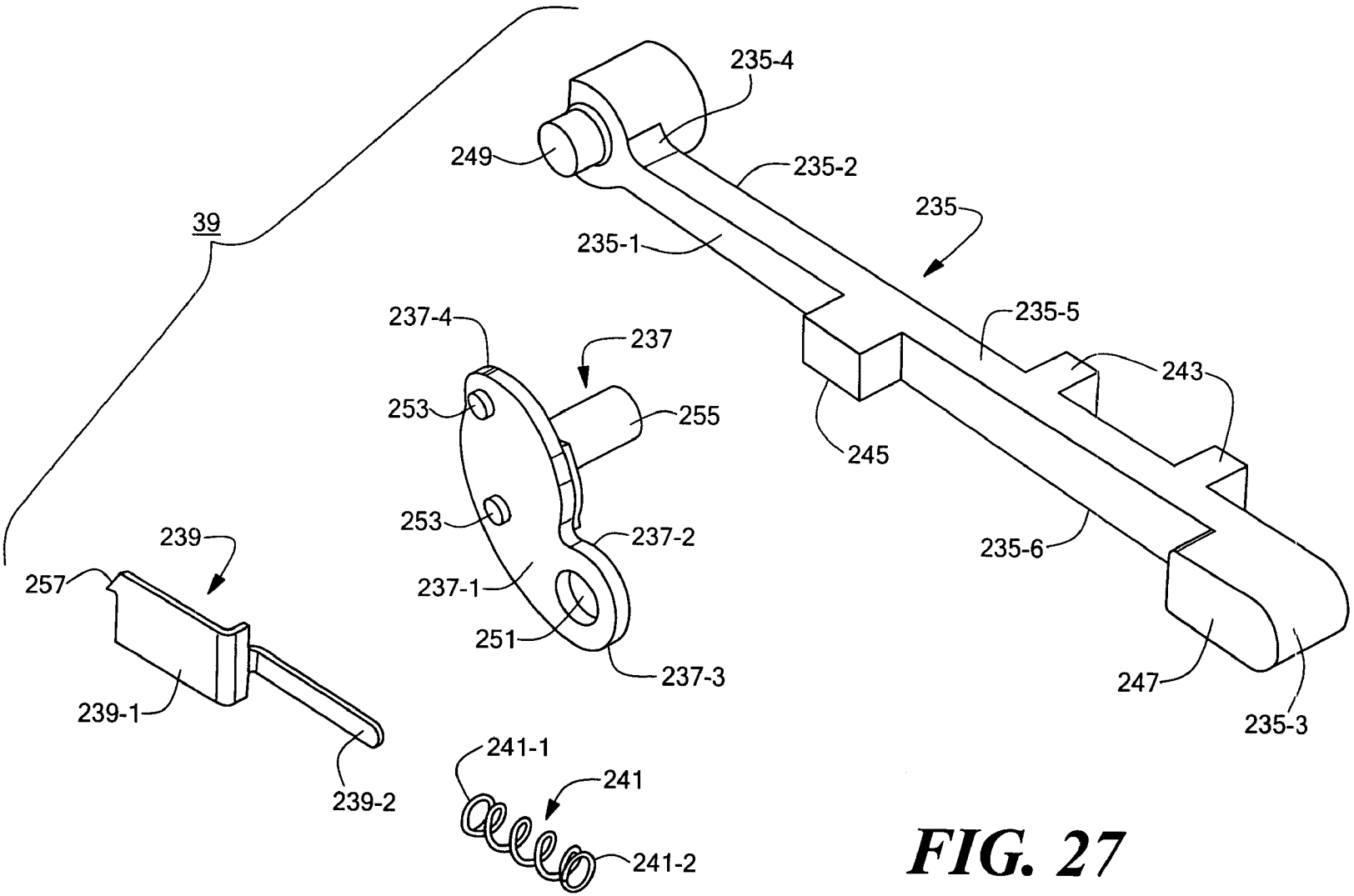
FIG. 27 is an enlarged, exploded, left rear top perspective view of the indexing mechanism of the tool shown in FIG. 1.

Referring now to FIG. 27, indexing mechanism 39 is slidably mounted within housing 29 and serves to load the cross-bar 19 of the lead fastener 15 of a fastener clip 13 in tool 11 into direct axial alignment behind bore 153 of needle 137 prior to the ejection process. Indexing mechanism 39 comprises a feed slide 235, a feed cam 237, a feed pawl 239 and a feed pawl spring 241.

Feed slide 235 is an elongated unitary member which may be molded of a rigid plastic (e.g., DELRIN) or another suitable material. Feed slide 235 is sized and shaped to be slidably mounted within feed slide channel 171 in needle slide 139 and includes a front surface 235-1, a rear surface 235-2, a first end 235-3 and a second end 235-4.

A pair of spaced apart projections 243 are integrally formed onto and extend orthogonally out from rear surface 235-2 of feed slide 235 proximate first end 235-3. With feed slide 235 mounted within feed slide channel 171 in needle slide 139, projections 243 protrude between support ribs 175 and 177. As such, the abutment of projections 243 against support ribs 175 and 177 serves to limit the forward and rearward displacement of feed slide 235 within feed slide channel 171.

A pair of spaced apart projections 245 and 247 are integrally formed onto and extend orthogonally out from the front surface 235-1 of feed slide 235 proximate first end 235-3. With tool 11 arranged in its assembled form, first end 121-1 of trigger link 121 is disposed against front surface 235-1 between projections 245 and 247, as seen most clearly in FIG. 5. As such, during the activation of trigger assembly 33, first end 121-1 of trigger link 121 selectively abuts against projections 245 and 247 so as to displace feed slide 235 in the forward and rearward directions, respectively.

A cylindrical post 249 is integrally formed onto and extends orthogonally out from the front surface 235-1 of feed slide 235 at second end 235-4. As will be described further below, post 249 is sized and shaped to pivotally receive feed cam 237.

Top and bottom surfaces 235-5 and 235-6 of feed slide 235 inwardly taper from first end 235-3 to second end 235-4. As a result, feed slide 235 is capable of limited vertical displacement between bottom wall 163 and partition 167 of needle slide 139.

Feed cam 237 is a unitary member which is pivotally mounted onto both needle slide 139 and feed slide 235. Feed cam 237 includes a front surface 237-1, a rear surface 237-2, a first end 237-3 and a rear end 237-4. First end 237-3 of feed cam 237 is shaped to define a generally circular opening 251 proximate first end 237-3. Opening 251 is sized and shaped to receive post 249 of feed slide 235. As such, first end 237-3 of feed cam 237 is capable of rotation about post 249.

A pair of spaced apart projections 253 are integrally formed onto and extend orthogonally out from front surface 237-1 of feed cam 237 proximate second end 237-4. As will be described further below, feed pawl 239 is sized and shaped to be disposed in flush contact against front surface 237-1 between projections 253.

A single, enlarged, cylindrical post 255 is integrally formed onto and extends orthogonally out from the rear surface 237-2 of feed cam 237 proximate second end 237-4. Post 255 is sized and shaped to project into a corresponding bore 256 which is formed into needle slide 139. As such, with tool 11 arranged in its assembled form, feed cam 237 is capable of rotation relative to needle slide 139 about post 255.

Feed pawl 239 is an elongated unitary member which is preferably made of metal (e.g., nickel plated steel 65) or another suitable material. Feed pawl 239 includes a front portion 239-1 and a rear portion 239-2. Front portion 239-1 is sized and shaped to lie flush against front surface 237-1 of feed cam 237 and in a fitting relationship between projections 253, as seen most clearly in FIGS. 28(*a*) and 28(*b*). The front end of front portion 239-1 is shaped to define a ratchet-shaped tooth 257 for selectively engaging the sharp edge 25-2 of the lead stub 25 of fastener clip 13 during the indexing process.

Feed pawl spring 241 is conventional in construction and includes a first end 241-1 and a second end 241-2. Feed pawl spring 241 is sized and shaped to axially mount onto rear portion 239-2 of feed pawl 239. With tool 11 arranged in its assembled form, first end 241-1 of spring 241 abuts against the rear of front portion 239-1 of feed pawl 239 and second end 241-2 of spring 241 abuts against a pair of spaced apart walls 259 which are integrally formed onto needle slide 139 at the front of feed slide channel 171, as seen most clearly in FIGS. 28(*a*) and 28(*b*). As such, feed pawl spring 241 resiliently urges feed pawl 239 forward for reasons to become apparent below.

Figure 28A:
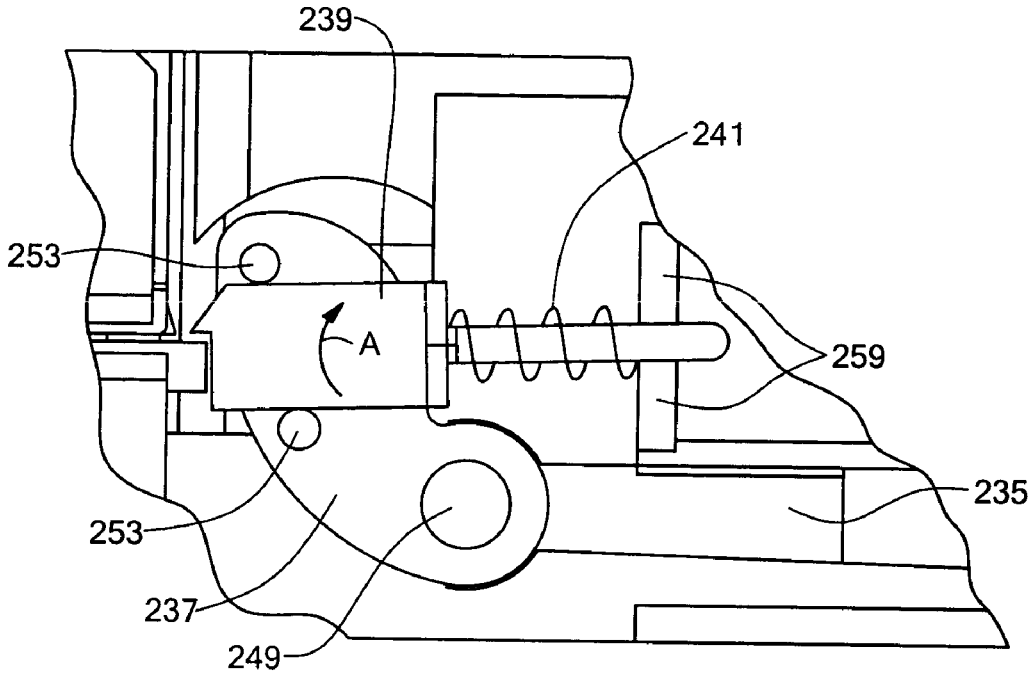
FIGS. 28(*a*) and 28(*b*) are enlarged, right side views of the tool shown in FIG. 1 at different stages during the indexing process, the tool being shown with the left half of the casing and the needle slide cover removed therefrom.
Figure 28B:
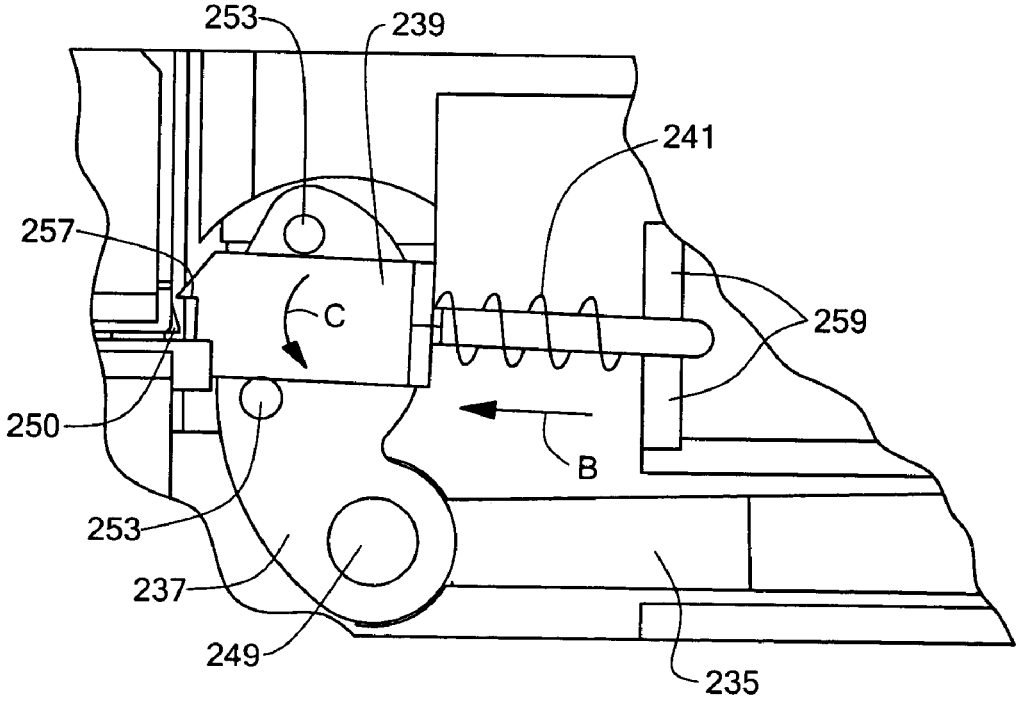

Indexing mechanism 39 operates in the following manner. As seen most clearly in FIG. 5, actuation of trigger 107 causes first end 121-1 of trigger link 121 to pivot counterclockwise and in the forward direction. The forward displacement of trigger link 121 eventually causes trigger link 121 to contact projection 245 and urge feed slide 235 forward. As noted briefly above, top and bottom surfaces 235-5 and 235-6 inwardly taper from first end 253-3 to second end 235-4 to allow for limited vertical displacement of feed slide 235 within feed slide channel 171. Referring now to FIG. 28(*a*), the forward displacement of feed slide 235 within feed slide channel 171 rotates feed cam 237 clockwise about post 255. As feed cam 237 rotates clockwise, projections 253 similarly carry feed pawl 239 in a clockwise direction, as represented by arrow A. The clockwise displacement of feed pawl 239 compresses spring 241. Due to its resilient construction, spring 241 expands, thereby advancing feed pawl 239 forward, as represented by arrow B in FIG. 28(*b*). In this manner, the ratchet-shape tooth 257 slides directly above the sharp edge 25-2 of the lead fastener stub 25 loaded into tool 11.

Referring now to FIG. 5, when trigger 107 is released, first end 121-1 of trigger link 121 pivots in a clockwise, generally rearward direction. The rearward displacement of trigger link 121 eventually causes trigger link 121 to contact projection 247 and urge feed slide 235 rearward. The rearward displacement of feed slide 235 within feed slide channel 171 rotates feed cam 237 counterclockwise about post 255. As feed cam 237 rotates counterclockwise, projections 253 similarly carry feed pawl 239 in a counterclockwise, generally downward direction, as represented by arrow C in FIG. 28(*b*). The downward displacement of feed pawl 239 causes tooth 257 to contact and subsequently urge sharp edge 25-2 of the lead fastener stub 25 downward so that the cross-bar 19 of the next successive fastener 15 is axially aligned behind bore 153 of needle 137.

In use, tool 11 can be used to retain a shirt in a folded condition in the following manner. Clip 13 of fasteners 15 is inserted into fastener clip bore 189 of needle slide 139 so that the cross-bar 19 of the lead fastener 15 is positioned behind bore 153 of needle 137. Having properly fed clip 13 into tool 11, a section of the folded shirt is positioned against brush 63. With the folded shirt positioned as such, the operator activates trigger 107 using a squeezing motion.

The activation of trigger 107 causes needle assembly 35 to advance forward through opening 51 in tool 11 and into its extended position. Specifically, needle assembly 35 advances forward until sharpened tip 151 of needle 137 penetrates through the folded shirt and enters into brush 63.

The activation of trigger 107 also causes ejection mechanism 37 to advance forward in such a manner so that ejector rod 231 enters into bore 153 of needle 137. As ejector rod 231 advances through bore 153, the lead fastener 15 is severed from the remainder of the fastener clip 13. As trigger 107 approaches the completion of its forward trigger stroke, ejector rod 231 pushes the cross-bar 19 of the lead fastener 15 entirely through needle 137. In this manner, cross-bars 19 and 21 are disposed on opposite sides of the shirt, thereby serving to help retain the shirt in its folded condition.

At the completion of the forward trigger stoke and at the commencement of the rearward trigger stroke, indexing mechanism 39 advances the next fastener 15 in clip 13 directly behind bore 153 of needle 137. Continued release of trigger 107 causes needle assembly 35 to return to its retracted position, thereby withdrawing needle 137 from the folded shirt. Simultaneously, ejection mechanism 37 retracts, with ejector rod 231 backing out from within bore 153 of needle 137.

At the completion of the rearward trigger stroke, the operator can either remove the shirt from against brush 63 or reposition another section of the shirt against brush 63 for additional fastener dispensing. The fastener dispensing process can be repeated continuously for the entire supply of fasteners 15 on clip 13.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A tool for dispensing plastic fasteners from a fastener clip, each plastic fastener having a cross-bar coupled to a common runner bar through a stub, said tool comprising:

(a) a housing formed from first and second halves, the housing comprising, (i) a handle portion, (ii) a barrel portion, and (iii) a funnel having opposite ends and being fixed at one of its ends onto the handle portion and fixed at the other of its ends onto the barrel portion, the funnel being shaped to define a runner bar guide channel, the runner bar guide channel being adapted to receive the common runner bar of said fastener clip, (b) a trigger assembly comprising a trigger which is pivotally mounted in said housing and which extends partially through the handle portion thereof for actuation, (c) a needle assembly mounted in the barrel portion of said housing, said needle assembly comprising a hollow, slotted needle, and (d) an ejection mechanism slidably mounted in the barrel portion of said housing, said ejection mechanism comprising an ejector rod which is insertable back and forth through said hollow needle.

2. The tool as claimed in claim 1 wherein the entirety of the funnel is integrally formed into the half of said housing.

3. The tool as claimed in claim 2 wherein said funnel is formed at one of its ends onto a front end of the barrel portion and is formed at the other of its ends onto a free end of the handle portion.

4. The tool as claimed in claim 3 wherein said handle portion and said funnel are shaped to define an opening therebetween into which the trigger extends.

* * * * *